US011083342B2

(12) United States Patent
Rivera et al.

(10) Patent No.: US 11,083,342 B2
(45) Date of Patent: Aug. 10, 2021

(54) AIR INJECTORS FOR BATHING INSTALLATIONS

(71) Applicant: NuWhirl Systems Corporation, Corona, CA (US)

(72) Inventors: Richard Rivera, Corona, CA (US); Lee Lina Ourn, Riverside, CA (US)

(73) Assignee: NuWhirl Systems Corporation, Corona, CA (US)

( * ) Notice: Subject to any disclaimer, the term of this patent is extended or adjusted under 35 U.S.C. 154(b) by 11 days.

(21) Appl. No.: 16/773,783

(22) Filed: Jan. 27, 2020

(65) Prior Publication Data

US 2020/0237164 A1 Jul. 30, 2020

Related U.S. Application Data

(60) Provisional application No. 62/797,884, filed on Jan. 28, 2019.

(51) Int. Cl.
*A47K 3/10* (2006.01)
*A61H 33/02* (2006.01)

(52) U.S. Cl.
CPC ..... *A47K 3/10* (2013.01); *A61H 2033/023* (2013.01)

(58) Field of Classification Search
CPC ..... A47K 3/10; A61H 2033/021; A61H 2033/022; A61H 2033/023
USPC ..... 4/541.5
See application file for complete search history.

(56) References Cited

U.S. PATENT DOCUMENTS

| | | | | |
|---|---|---|---|---|
| 3,251,071 | A | 5/1966 | Wood | |
| 3,467,969 | A | 9/1969 | Szekely | |
| 4,000,528 | A | 1/1977 | Posnick | |
| 4,010,498 | A | 3/1977 | Jablonski | |
| 4,166,296 | A | 9/1979 | Darrah et al. | |
| 4,170,044 | A | 10/1979 | Steimle | |
| 4,237,562 | A | 12/1980 | DuPont | |
| 4,628,908 | A | 12/1986 | Dupont | |
| 4,857,112 | A | 8/1989 | Fränninge | |
| 4,954,179 | A | 9/1990 | Fränninge | |
| 5,381,563 | A * | 1/1995 | Isabelle | A61H 33/026 137/859 |
| 5,548,854 | A | 8/1996 | Bloemer et al. | |
| 5,604,940 | A | 2/1997 | Shimizu | |
| 5,898,958 | A | 5/1999 | Hall | |
| 5,930,851 | A | 8/1999 | Brunelle | |
| 6,317,903 | B1 | 11/2001 | Brunelle et al. | |

(Continued)

OTHER PUBLICATIONS

"Hot Tub Air System: Air Injectors", Hot Tub Warehouse, retrieved from internet on Aug. 2, 2017, <https://www.hottubwarehouse.com/air-injectors>.

(Continued)

*Primary Examiner* — Huyen D Le
(74) *Attorney, Agent, or Firm* — Knobbe, Martens, Olson & Bear LLP

(57) ABSTRACT

Air injectors are provided for conveying fluid and/or gas (e.g., air) into the fluid of a bathing apparatus. The air injectors can include a component for attachment to an outside surface of the bathing apparatus that can be hidden from the view of a user and another component for attachment to a source of the fluid and/or gas (e.g., air). The two components can be connected together for use or disconnected for servicing and cleaning the injectors, as well as servicing a check valve or the injectors.

21 Claims, 16 Drawing Sheets

(56) References Cited

U.S. PATENT DOCUMENTS

| | | | | |
|---|---|---|---|---|
| 6,427,257 | B1 | 8/2002 | Castellote | |
| 6,782,309 | B2 | 8/2004 | Laflamme et al. | |
| 6,792,627 | B2 | 9/2004 | Sangha et al. | |
| 7,146,659 | B2 | 12/2006 | Mattson, Jr. et al. | |
| 7,158,909 | B2 | 1/2007 | Tarpo et al. | |
| 7,292,898 | B2 | 11/2007 | Clark et al. | |
| 7,370,375 | B2 | 5/2008 | Phillips | |
| 7,398,138 | B2 | 7/2008 | Emery et al. | |
| 7,448,095 | B1 | 11/2008 | Agaeliaho | |
| 7,454,802 | B2 | 11/2008 | Tennant et al. | |
| 7,489,986 | B1 | 2/2009 | Laflamme et al. | |
| 7,503,082 | B2 | 3/2009 | Castellote | |
| 7,614,095 | B2 | 11/2009 | Swart et al. | |
| 7,665,158 | B2 | 2/2010 | Castellote | |
| 7,849,529 | B2 | 12/2010 | Bedard | |
| 8,150,552 | B2 | 4/2012 | Brochu et al. | |
| 8,220,083 | B2 | 7/2012 | Strickland | |
| 8,235,360 | B2 | 8/2012 | Castellote et al. | |
| 8,612,061 | B2 | 12/2013 | Laflamme et al. | |
| 8,644,960 | B2 | 2/2014 | Laflamme et al. | |
| 8,688,280 | B2 | 4/2014 | Macey | |
| 8,739,323 | B2 | 6/2014 | Lee | |
| 8,931,121 | B2 | 1/2015 | Fabian | |
| 8,984,678 | B2 | 3/2015 | Brunelle et al. | |
| 9,066,634 | B2 | 6/2015 | Campbell et al. | |
| 9,066,635 | B2 | 6/2015 | Campbell et al. | |
| 9,078,802 | B2 | 7/2015 | Brochu et al. | |
| 9,114,060 | B2 | 8/2015 | Ciechanowski et al. | |
| 9,173,808 | B2 | 11/2015 | Ciechanowski et al. | |
| 9,259,374 | B2 | 2/2016 | Castellote et al. | |
| 9,442,639 | B2 | 9/2016 | Laflamme et al. | |
| 9,526,672 | B2 | 12/2016 | Kownacki et al. | |
| 2002/0062520 | A1* | 5/2002 | Castellote | A61H 33/026 4/541.5 |
| 2002/0084699 | A1 | 7/2002 | Kemp | |
| 2003/0233704 | A1 | 12/2003 | Castellote | |
| 2004/0199991 | A1 | 10/2004 | Ciechanowski | |
| 2005/0055763 | A1 | 3/2005 | Castellote | |
| 2005/0172392 | A1 | 8/2005 | Swart et al. | |
| 2005/0288821 | A1 | 12/2005 | Laflamme et al. | |
| 2006/0107455 | A1 | 5/2006 | Bedard | |
| 2006/0112525 | A1 | 6/2006 | Castellote | |
| 2006/0115245 | A1 | 6/2006 | Castellote | |
| 2007/0093919 | A1 | 4/2007 | Ciechanowski | |
| 2008/0039977 | A1 | 2/2008 | Clark et al. | |
| 2008/0172783 | A1 | 7/2008 | Smith et al. | |
| 2011/0093099 | A1 | 4/2011 | Tran et al. | |
| 2011/0202150 | A1 | 8/2011 | Tran et al. | |
| 2012/0272448 | A1 | 11/2012 | Ciechanowski et al. | |
| 2014/0033420 | A1* | 2/2014 | Campbell | A47K 3/10 4/541.5 |
| 2014/0033421 | A1* | 2/2014 | Campbell | A61H 33/026 4/541.5 |
| 2015/0231029 | A1 | 8/2015 | Brett | |
| 2016/0342323 | A1 | 11/2016 | Laflamme et al. | |
| 2017/0058498 | A1 | 3/2017 | Castellote | |
| 2017/0298604 | A1 | 10/2017 | Van Spengen | |

OTHER PUBLICATIONS

Air Massage Catalog, Balboa Water Group, available on or before Sep. 26, 2017, in 44 pages.

CMP Bath Products Catalog, CMP, 2017, in 96 pages.

Spa Products Catalog 2017, HydroQuip, Inc., Aug. 16, 2017, in 140 pages.

Air System, CG Air Systèmes Inc., available on or before Sep. 26, 2017, in 2 pages.

Product Catalog V.05, CG Air Systèmes Inc., available on or before Sep. 26, 2017, pp. 1-13-1-16.

Illusion Air System Installation, available on or before Sep. 26, 2017, in 1 page.

Bath Products Buyer's Guide, Waterway Plastics, Inc., Sep. 1, 2015, in 72 pages.

* cited by examiner

AIR INJECTORS FOR BATHING INSTALLATIONS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57. This application claims the benefit of priority to U.S. provisional application 62/797,884, filed Jan. 28, 2019, the entire contents of which are hereby incorporated by reference.

BACKGROUND

Field

This disclosure relates to air injectors for bathing installations and bathing apparatuses. In particular, this disclosure relates to air injectors that are esthetically pleasing from the point of view of the user and are easy to service.

Description of the Related Art

Bathing installations and bathing apparatus, such as bathtubs, spas, and whirlpool baths may have air injectors to supply a stream of air into the bath water thereby providing in the water a stream of pressurized bubbles which may enhance the bathing experience.

Such injectors may be placed in the walls, bottom, or floor of the bathing installation or apparatus, extend through the bath wall and/or base, and be coupled together via piping that is in communication with a pump to provide pressurized air.

SUMMARY

Conventional air injectors are mounted in such a way that at least some of the injector projects into the bath, for example by having a flange mounted against the interior surface of the bath. Such injectors may therefore be seen by a user and also provide some obstruction along the inner surface of the bath.

Air injectors may comprise a check valve to prevent backflow or material getting collected in the plumbing and possibly reaching and damage the pump. Having a check valve built in prevents water from accumulating in the air line which can stagnate when the bathing apparatus is not in use. Servicing the injector and cleaning the injector, including the check valve, can be awkward and time consuming.

This disclosure provides air injectors that, when installed in a bathing apparatus, are substantially invisible inside a bath or tub. In some embodiments, no part of the air injector may be visible or installed inside the bath or tub. When viewed from inside the bath or tub, only a hole may be seen by the user. These air injectors can be installed from the outside or the rear of the bathing apparatus by means of one or more holes through the wall of the bathing apparatus.

This disclosure provides air injectors configured so that they can easily be serviced. For example, air injectors of this disclosure may comprise a check valve. If any debris or hair gets into the air injector, it may be obstructed and not work properly. Air injectors of this disclosure may comprise a assembly/dis-assembly mechanism that avoids the need to disconnect a component of the air injector from the fluid and/or gas (e.g., air) supply tubing when maintenance is needed for the check valve or other component.

This disclosure provides air injectors configured so that they can be easily installed. In some embodiments, components of the air injectors can be assembled together without tools or with minimal tool(s). In some embodiments, the air injector can be operatively connected to air supply tubing without requiring tools or with minimal tool(s). In some embodiments, air injectors of this disclosure may comprise an assembly mechanism that avoids the need to disconnect the air injector from tubing for conveying fluid and/or gas (e.g., air) to the air injector. For example, the air injectors may be connected to in series or parallel to a common main tubing that supplies fluid and/or gas (e.g., air) without each air injector being individually connected to the common or main tubing in order to receive fluid and/or gas (e.g., air).

Air injectors of this disclosure may include a connector and/or disconnector mechanism or system that does not require a portion of the air injector to rotate with respect to another portion of the air injector or common tubing. For example, air injectors of this disclosure may avoid the use of a screw thread type connection between a portion of the air injector attached or for attachment to the bath and a portion attached or for attachment to tubing for supplying fluid and/or gas (e.g., air) to the injector. Accordingly, the air injectors of this disclosure may not need the use of tools that rotate or otherwise move around the injector in order to install them or service them. The injectors of this disclosure therefore may need less space and be easier to maintain. Furthermore, the air injectors of this disclosure can be installed at a variety of rotational orientation without impacting performance. In some embodiments, a screw thread type connection can be used. In some embodiments, a snap fit, tight fit, friction fit, and/or the like mechanism can be used to connect to the air injectors to each other, tubing, or common tubing.

This disclosure provides air injectors comprising an assembly and/or disassembly mechanism or system comprising a plurality of projections extending from a first portion of the air injector and a surface or surfaces (e.g., indentations, openings, grooves, and/or the like) on a second portion of the air injector configured to receive or engage (e.g., snap fit or friction fit) with the projections to connect the first and second portion together or disconnect them. This mechanism or system may operate without the need to rotate the first portion with respect to the second portion. In some embodiments, the first portion may rotate with respect to the second portion, allowing the air injector to be installed at a variety of rotational orientations. The first portion may be adapted for connection to a bath. The second portion may be adapted for connection to tubing for conducting fluid and/or gas (e.g., air) to the air injector. The tubing can be any suitable structure, piping, conduits, elbows, bends, and/or the like for conveying fluid and/or gas (e.g., air) for bathing. The tubing may be flexible or rigid (e.g., include elbows and bends in the tubing and/or air injector to position the air injectors and tubing in a desired orientation and/or position).

This disclosure provides an air injector comprising first and second portions each comprising a generally cylindrical body having a passage therethrough for conducting fluid and/or gas (e.g., air). Each body may comprise a terminal section engageable and dis-engageable with respect to the other terminal section. The first portion may be configured for attachment to the outside surface of a bath and/or other bathing environment. This engagement and dis-engagement may be achieved without the necessity to rotate the body of the second portion with respect to the body of the first portion.

The air injectors of this disclosure may comprise a component or portion configured to attach to a bathing installation and a component or portion configured to attach to a conduit for supplying fluid and/or gas (e.g., air, water, and/or any other suitable/desired fluid or gas for bathing).

The aforesaid connector/disconnector mechanism, assembly/disassembly, and engagement/dis-engagement features may comprise mating members/connections located on respective portions or components of the air injectors.

These members may comprise a plurality of hooks or clips on one portion or component, preferably the one for attachment to a bath, and one or more engagement members on the other portion or component of the air injector shaped to engage the respective hooks or clips.

The hooks or clips may be sufficiently flexible to latch onto the engagement member and then elastically regain their shape to hold the portions or components of the air injectors until they are to be de-coupled, e.g., for servicing, cleaning, and/or replacement.

One arrangement comprises a circumferential collar, sleeve, flange, and/or the like on the component or portion configured to attach to a conduit for supplying fluid and/or gas (e.g., air, water, and/or any other suitable/desired fluid or gas for bathing).

More particularly, the component or portion (e.g., a hat, top, etc.) configured to attach to a bathing installation may comprise, at a first end, a flange or plate configured for such attachment and a generally cylindrical member extending from the flange or plate to a second end. On a surface of the flange or plate opposite from the generally cylindrical member a plurality of recesses or channels may be formed. The recesses or channels may be concentric rings and are for receiving adhesive used to fix the flange or plate to the exterior surface of a bath.

The flange or plate may have an opposing surface from which extends a generally cylindrical hollow body forming an inlet for fluid and/or gas (e.g., air, water, and/or any other suitable/desired fluid or gas for bathing) to be conducted to the bathing installation, when in use. Extending from that cylindrical body may be the connector/disconnect mechanism, such as the hooks or clips described herein.

The component or portion configured to attach to a source of fluid and/or gas (e.g., air, water, and/or any other suitable/desired fluid or gas for bathing), and to the component or portion configured to attach to the bath, may comprise a generally cylindrical body, which may be angled in the form of an elbow. This component or portion may have an inlet section for connection to the source of fluid and/or gas (e.g., air, water, and/or any other suitable/desired fluid or gas for bathing) and an outlet section for connection to the component or portion configured to be attached to the bath.

The outlet portion may comprise an annular collar sized to fit within the hollow cylindrical portion of the component or portion configured to be attached to the bath. The outlet portion can provide an annular engagement portion for connection of the hooks or clips described herein.

The inside of the outlet section is typically generally cylindrical and open and may have internal surfaces to seat a one way valve, such as a fluid and/or gas (e.g., air) check valve.

This disclosure also provides a method of attaching the injectors described herein to a bath which comprises aligning the injector using a rod or the like extending through a hole in the bath and into a hole centrally located in the flange or plate. The rod is used to properly align the flange or plate with the hole in the bath in a desired position and/or orientation as it is attached to the outer wall of the bath by adhesive, such that fluid and/or gas (e.g., air, water, and/or any other suitable/desired fluid or gas for bathing) flowing through the injector will flow into the bath via the hole in the bath.

This disclosure provides air injectors for bathing apparatuses. The air injector can have a mounting cap for attachment to an outside surface of the bathing apparatus. The mounting cap can include a plate having an upper surface and a lower surface with a peripheral surface extending therebetween. The mounting cap can have a hole extending through the upper and lower surface. The mounting cap can include a housing that can have a receiving tube that can include a wall surrounding the hole. The housing can extend from a first end at said lower surface of the plate to a second, open end having an internal diameter and one or more engagement arms extending away from the second end. The air injector can have a pipe fitting that has a cylindrical body with an external surface having an outer circumference. The pipe fitting can have a first open end having a raised portion or portions extending at least partially around the outer circumference and radially away from the external surface. The internal diameter of the receiving tube can be sized to fit over the first open end of the pipe fitting with the engagement arms being able to engage the raised portion or portions so as to releasably hold the mounting cap and pipe fitting together.

In some embodiments, the engagement arms can include two engagement arms that are positioned on opposing sides of the receiving tube.

In some embodiments, each of the engagement arms can have a clip that can engage with the raised portion or portions of the pipe fitting.

In some embodiments, the clip includes a curved surface that has a radius of curvature that is the same as the raised portion or portions of the pipe fitting.

In some embodiments, the engagement arms can be curved.

In some embodiments, the engagement arms can engage with the raised portion or portions of the pipe fitting with a snap-fit connection.

In some embodiments, the engagement arms can deflect radially outward over the raised portion or portions. The engagement arms can return to an un-deflected state with the clip extending past the raised portion or portions.

In some embodiments, the pipe fitting can rotate with respect to the mounting cap in a coupled configuration.

In some embodiments, the raised portion or portions can include a flared portion that can deflect the engagement arms radially outward.

In some embodiments, the raised portion or portions can have one or more channels that can receive O-rings that can engage with an inner surface of the receiving tube.

In some embodiments, an inner surface of the receiving tube can have one or more channels that can receive O-rings that can engage with the raised portion or portions.

In some embodiments, the air injector can have a check valve that can provide for one-way flow through the air injector. The check valve can have a spring that applies a force that can position the check valve to prevent fluid from flowing into the pipe fitting and that can be overcome by pressurized air flowing through the pipe fitting to move the check valve to allow pressurized air to flow out the hole of the mounting cap.

In some embodiments, the pipe fitting can include a barbed nozzle that can operatively couple with a tube that supplies pressurized air.

In some embodiments, the pipe fitting can include a second barbed nozzle that can operatively couple with a tube that is connected to another air injector.

In some embodiments, the upper surface of the plate can have grooves that can receive an adhesive to couple the upper surface of the plate to an outer surface of a bathing apparatus.

This disclosure provides air injectors for bathing apparatuses. The air injector can include a bath mount. The bath mount can include a plate having an upper surface and a lower surface. The upper surface can have one or more grooves that can receive an adhesive to couple the upper surface of the plate to an outer surface of a wall of a bathing apparatus that is not configured to contact fluid held by the bathing apparatus. The bath mount can have a hole extending through the upper and lower surfaces of the plate. The hole can be aligned with a hole in the wall of the bathing apparatus. The bath mount can have a cylindrical body that extends away from the lower surface of the plate and can have an internal chamber. The bath mount can have one or more arms that extend away from the cylindrical body. The one or more arms can have a hook and can deflect. The air injector can have a pipe fitting. The pipe fitting can have a second end that has an inlet. The second end can operatively couple to tubing that can direct pressurized air. The pipe fitting can have a collar positioned on a first portion of the pipe fitting. The collar can have an internal seating that can receive a fluid check valve that can prevent fluid flow through the pipe fitting away from the bathing apparatus. The collar can be inserted into the internal chamber of the cylindrical body such that the one or more arms extend beyond the collar. A clip of each of the one or more arms can couple to the collar with a snap-fit connection such that the pipe fitting and the bath mount can be separable for servicing of the fluid check valve.

In some embodiments, the pipe fitting and the bath mount can be separable for servicing of the fluid check valve without rotation of the pipe fitting with respect to the bath mount.

In some embodiments, this disclosure provides a method of installing an air injector in a bathing apparatus. The method can include applying an adhesive to an upper surface of a plate. The method can include aligning a hole of the plate with a hole in a wall of a bathing apparatus that can hold a fluid. The method can include adhering the upper surface of the plate to a hidden surface of a wall of the bathing apparatus that is opposite a surface that can interface with the fluid held by the bathing apparatus. The method can include inserting a check valve into a pipe fitting. The method can include coupling a receiving tube attached to the plate with a collar of the pipe fitting with a snap-fit connection.

In some embodiments, the method can include operatively coupling the pipe fitting to a tube that can supply pressurized air.

In some embodiments, aligning the hole of the plate with a hole in a bathing apparatus can include inserting a rod through the hole in the bathing apparatus and maneuvering the plate relative to the rod to position the rod through the hole of the plate.

In some embodiments, coupling the receiving tube attached to the plate with the collar of the pipe fitting with a snap-fit connection can include inserting the collar of the pipe fitting into the receiving tube attached to the plate such that arms extending away from the receiving tube deflect radially outward and advancing the collar of the pipe fitting into the receiving tube such that clips at the end of each of the arms snaps around an end of the collar to couple the pipe fitting to the plate.

BRIEF DESCRIPTION OF THE DRAWINGS

Various embodiments are depicted in the accompanying drawings for illustrative purposes and may not be drawn to scale, and should in no way be interpreted as limiting the scope of the embodiments. In addition, various features of different disclosed embodiments can be combined to form additional embodiments, which are part of this disclosure. Similarly numbered or named features may refer to like elements with the same or similar characteristics. The below brief description of the figures are example embodiments according to this disclosure.

DETAILED DESCRIPTION

Figure 1:
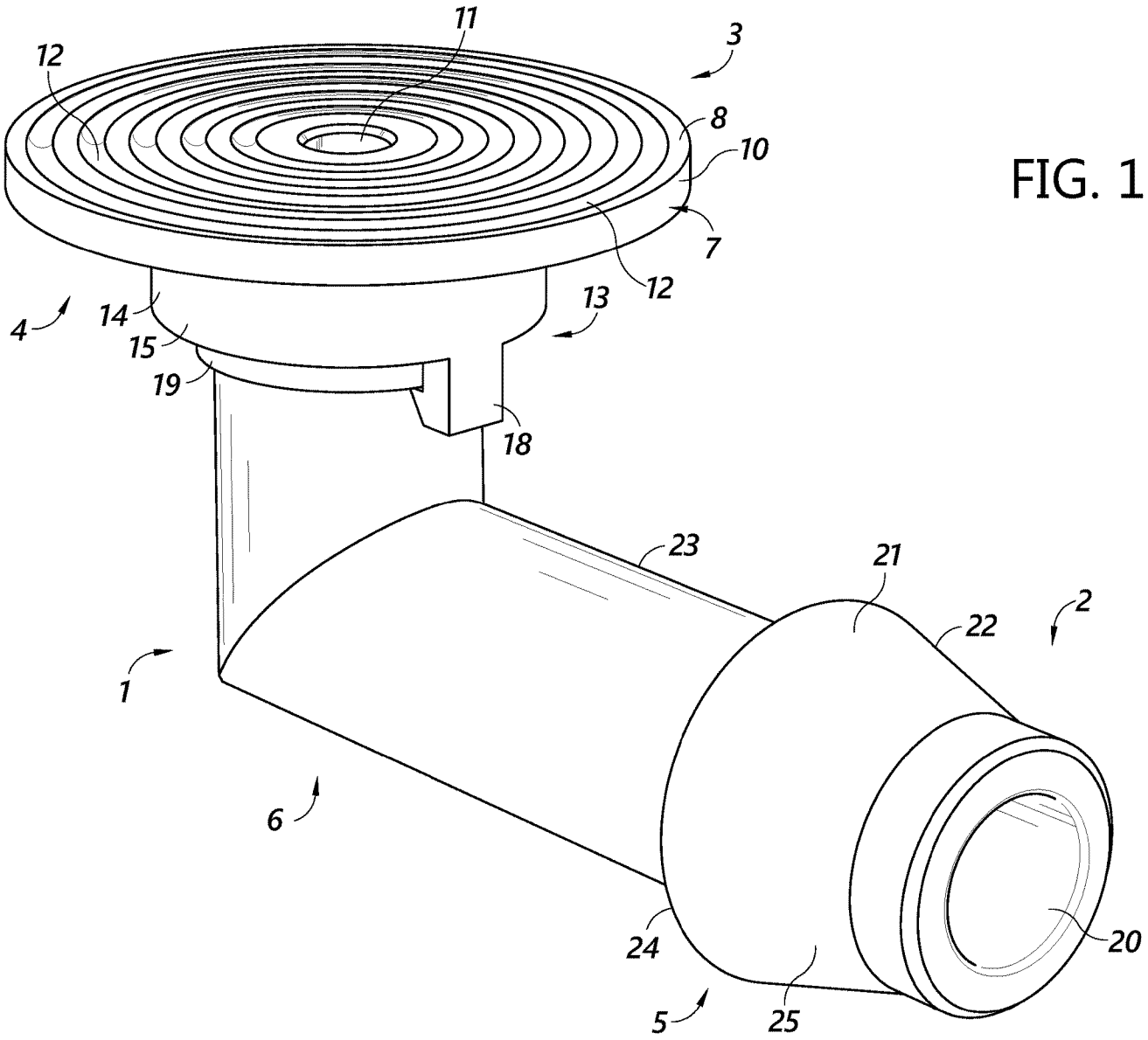
FIG. 1 is a perspective view of an air injector of this disclosure.

FIG. 1 illustrates an air injector (1) of the disclosure. Air injector (1) comprises a distal end (second end, end) (2) and a proximal end (first end, end) (3). Proximal end (3) includes a bath mount (cap, mounting cap, mount, hat, plate member, coupler) (4). As detailed herein, the proximal end (3), when installed in a bathing apparatus, is proximate a wall of the bathing apparatus, while distal end (2) can be, relative to the proximal end (3), more distally positioned. Proximal and distal can be used throughout this disclosure in relation to proximity to the wall of the bathing apparatus upon which the air injector is/will be coupled, unless described differently. It will be understood that reference herein to a "bath"

or "bathing installation" or the like, can refer to a bath structure that typically has walls on a base portion forming a reservoir for collecting water in which to bathe. Such baths may be conventional water baths, walk-in baths, and/or hydrotherapy baths or the like.

Distal end (2) can include a connector (nozzle, barbed nozzle, inlet) (5) that can connect to tubing that supplies air, such as pressurized air to the air injector (1). In some embodiments, distal end (2) has a connector (5) that can connect to tubing that supplies fluid and/or gas (e.g., air, water, and/or any other suitable/desired fluid or gas for bathing) to the air injector (1). Bath mount (4) and connector (5) are connected together via piping, which can be in the form of an elbow (pipe fitting, conduit, T-fitting, straight fitting, straight connector, curved connector) (6). Elbow (6) has a passageway therethrough (as can be seen in FIG. 4) to enable the transmission of fluid and/or gas (e.g., air) from the connector (5) to the bath mount (4). Elbow (6) can have a cylindrical body, which can be curved, angled, straight, and/or other configurations. Bath mount (4) comprises a flange member (flange, plate, disk) (7) having an upper surface (top surface) (8) and a lower surface (bottom surface) (9) (as may be seen in FIG. 3). Upper surface (8) and lower surface (9) are separated by a peripheral wall (10). The upper surface (8) can be parallel with the lower surface (9). The upper surface (8) can have a periphery that is the same as or similar to the lower surface (9).

Flange member (7) can be generally circular in shape, as illustrated. In some embodiments, the flange member (7) can be other shapes, such polygonal and/or irregular. The flange member (7) has a hole (aperture, opening, outlet) (11) therethrough that extends through the upper surface (8) and the lower surface (9). The hole (11) can be centrally located on the flange member (7) or in other positions. In use, the hole (11) is the outlet for fluid and/or gas (e.g., air) passing through the air injector (1).

The upper surface (8) of flange member (7) can have a plurality of channels (recesses, grooves, depression, indentations) (12). In FIG. 1, the channels (12) are shown as being a series of concentric channels (12) around hole (11). In some embodiments, channels or recesses (12) of different shapes and/or dimensions may be used. The purpose of such channels or indentations is to receive adhesive (bonding agent, glue, mortar) which serves to bond (adhere) the flange member (7), specifically the upper surface (8), to the outside surface of a bath, for example, to an outside wall or the base thereof. The hole (11) can be aligned with a hole in the wall of the bath such that fluid and/or gas (e.g., air) flowing through the air injector (1) will exit via the hole (11) and into the bath. The hole (11) and the hole in the wall of the bath can be aligned with a rod or other tool, as described elsewhere herein, by inserting the rod through the hole in the wall of the bath and maneuvering the flange member (7) such that the rod extends through the hole (11). The flange member (7), with adhesive on the upper surface (8) can be advanced to interface the upper surface (8) with the outside surface of the bath such that the flange member (7) is adhered to the outside surface of the bath.

Bath mount (4) can include a connector housing (housing, coupler housing, tubular member, cylinder) (13) for connecting bath mount (4) to elbow (6). Connector housing (13) can include a generally cylindrical component (cylinder, tube, tubular structure, receiving tube) (14) extending away (e.g., downwardly) from the lower surface (9) of flange member (7). Cylindrical component (14)can have a wall having an outer surface (15) and an inner surface (16) (as may be seen in, for example, FIG. 4). The cylindrical component (14) can surround and/or enclose the hole (11). Outer surface (15) and inner surface (16) form an internal chamber (17) (as may be seen in FIG. 4). The internal chamber (17) is sized to receive a portion of the elbow (6), as clearly shown in FIG. 5. Specifically, the internal chamber (17) is sized to receive a proximal portion (first end, first open end) (40) and/or collar (19) of the elbow (6). The cylindrical component (14) can extend from a first end at the lower surface (9) of the flange member (7) to a second, open end having an internal diameter. The cylindrical component (14) can be a tube that is affixed to the lower surface (9) of the plate (7).

Cylindrical component (14) can have connector elements (connectors, arms, clips, protrusions, grips, hooks, engagement members) (18) that are used to couple the bath mount (4) to the elbow (6). In some embodiments, the cylindrical component (14) has two connector elements (18), which can be positioned on opposing sides of the cylindrical component (14). In some embodiments, the cylindrical component (14) can have three, four, or more connector elements (connectors as discussed herein) (18). In some embodiments, the connector elements (18) are arms that extend away from the cylindrical component (14) in a direction that is opposite from the plate member (7). The arms (18) can be elongate and elastically deflect upon application of a load thereon. The connector elements (18), or arms, can interface with a raised collar (annular body, projection, annular projection, collar, raised portion, circumferential raised portion) (19) of the elbow (6). The connector elements (18) can facilitate a snap-fit connection with the raised collar (19). The connector elements (18) can deflect outward upon placement over a proximal portion (first end, first open end) (40) and/or collar (19), shown in FIG. 2, of the elbow (6) and return to an un-deflected state upon extending past a edge (distal edge) of the raised collar (19). Stated differently, connector elements (18) can connect the bath mount (4) to the elbow (6) by engaging with a raised collar (19) on elbow (6). As described in more detail in reference to FIG. 5, each of the arms (18) can include a clip on an end thereof that can engage with a raised collar (19) of the elbow (6). In some embodiments, the bath mount (4) does not have connector elements (18). In some embodiments, the bath mount (4) couples to the pipe fitting (6) via a locking pin(s), attachment collar nut, friction fit, press fit, snap-fit, interfacing raised collar(s), and/or via other techniques, which may not include the connector elements (18). In some embodiments, a twist lock, threaded connection, and/or other manner of coupling can be used to couple the bath mount (4) to the elbow (6).

The distal end (2) of the air injector (1) can have a connector, (nozzle, barbed nozzle, inlet) (5) that can be operatively connected to tubing that can provide pressurized fluid and/or gas (e.g., air) to the air injector (1). The connector (5) can have an inlet (opening) (20) through which fluid and/or gas (e.g., air, such as pressurized air), can flow into the air injector (1).

The connector (5) can have a collar component (collar, barb, inclined surface, raised inclined surface) (21). The collar component (21) can be adjacent or proximate inlet (20). The collar component (21) can be at and/or proximate the distal end (2). The collar component (21) can have an external wall (22) diverging (extending) away from an external surface (exterior surface, outer surface) (23) of elbow (6). The collar component (21) can have a raised periphery (24) standing proud of (extending away from) the external surface (23) of elbow (6). Periphery (24) can define a sloped outer surface (25). The sloped outer surface (25) can define a decreasing profile of the periphery (24) in the proximal-distal direction. The periphery (24), and the sloped outer surface (25), encircle the external surface (23) of elbow (6) at, adjacent, and/or proximate the distal end (2). The connector (5) operatively couples with tubing or piping that can supply fluid and/or gas (e.g., air, such as pressurized air), to the air injector (1). Specifically, the connector (5) can be inserted into the inner cavity of tubing such that the tubing is operatively coupled to the elbow (6). Fluid and/or gas (e.g., air) flowing through the inner cavity of the tubing can flow into the air injector (1) via the inlet (20). The pipe fitting (6) can have a connector (5) that can operatively couple via a variety of fastening techniques (e.g., press-fit, friction-fit, slip-fit, push-fit, and/or other techniques, such as using quick-connect fittings) to tubing that can supply a fluid and/or gas for bathing. For example, the pipe fitting (6) can have a connector (5) that is a slip-fit tubing connector (e.g., at least partially made of rubber or other elastic material) that receives an end of a tube therein such that the pipe-fitting (6) is operatively connected to the tubing with the tubing at least partially deforming the elastic material of the connector (5) to provide a substantially secure and leak-free connection with the tubing. This can advantageously enable a user to push the tubing into the connector (5) to efficiently and quickly couple the pipe fitting (6) to tubing.

Figure 2:
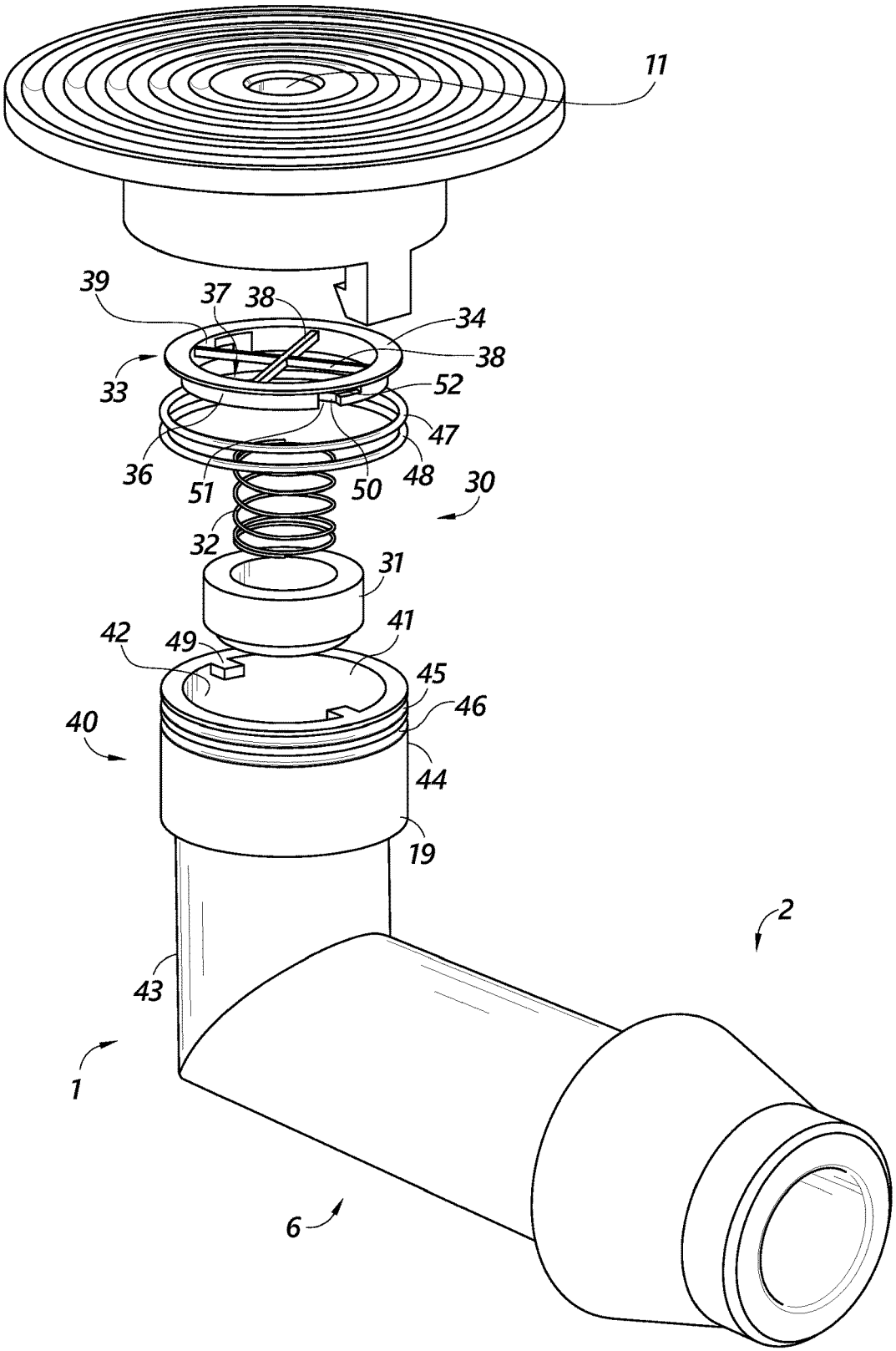
FIG. 2 is a perspective, exploded view of the air injector of FIG. 1, showing certain internal elements.

FIG. 2 illustrates an exploded representation an air injector (1). The air injector (1) can have a valve assembly (valve, flow controller) (30) that can provide for the one-way flow of fluid and/or gas (e.g., air) through the air injector (1). For example, the valve assembly (30) can allow pressurized fluid and/or gas (e.g., air) to flow out the hole (11) and into the bathing environment while impeding the flow of water into the elbow (6). Specifically, the valve assembly (30) can include a check valve (stopper, plug) (31). In use, the check valve (31) prevents or inhibits water, which may be proximal of valve (31), from reaching the distal end (2) of the air injector (1). This can prevent water from getting into the fluid and/or gas (e.g., air) supply system and damaging the air pump. The check valve (31) can be made of a variety of materials, such as polymers (rubber, silicone).

Valve assembly (30) can include a spring (32) (coil spring, butterfly spring, leaflet, elastic member) and a cap member (cap, retainer, top, annular component, annular structure, annular cap) (33). The cap member (33) can be an annular structure, as shown in FIG. 2.

Figure 3:
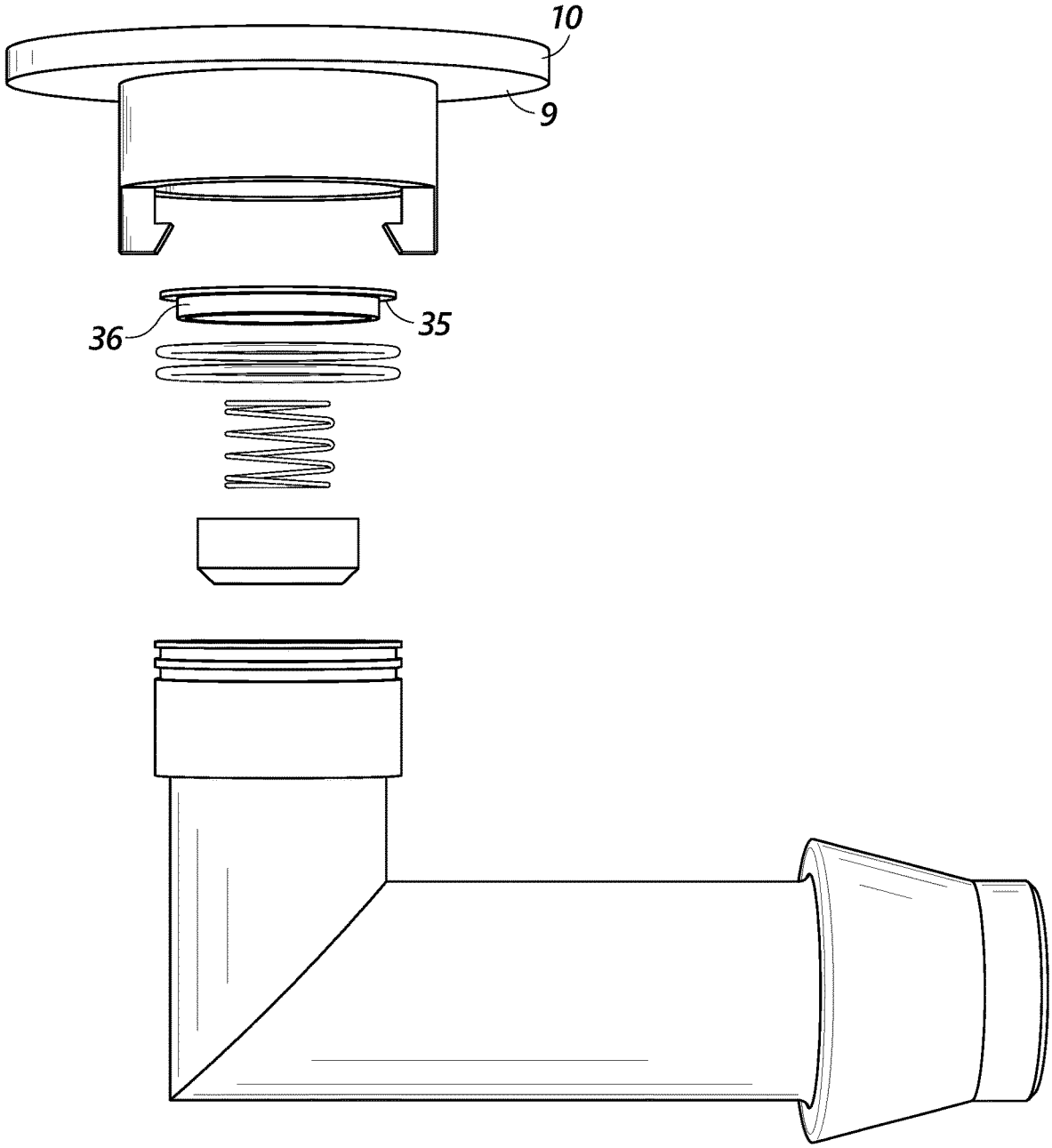
FIG. 3 is a side view of FIG. 2.
Figure 4:
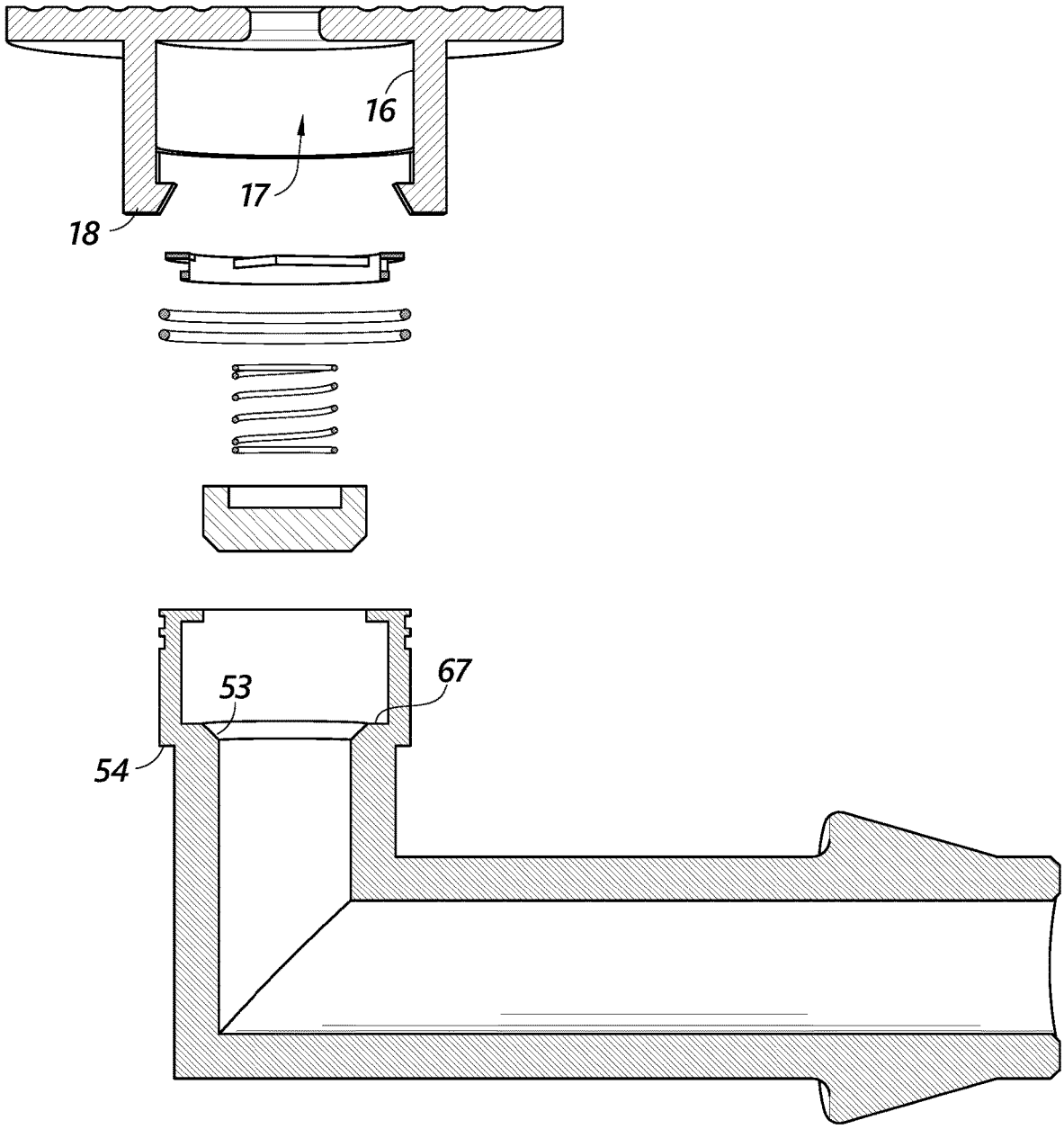
FIG. 4 is a cross-section view of FIG. 3, showing certain elements of that air injector in cross-sectioned view.

Cap member (33) can have an upper annular surface (34) and a lower annular surface (35), as may be seen in FIGS. 3 and 4. Projecting away from lower surface (35) is a generally annular or cylindrical wall (36). The cap member (33), including the upper surface (34), has a hole (37) extending therethrough, which may be centrally located. Struts (38) can extend across hole (37). Struts (38) can extend across the center of hole (37). Struts (38) can extend across the hole (37) to opposing positions along the inner surface (39) of the cylindrical wall (36). Struts (38) can include a pair of struts (38) that intersect at the center of the hole (37) and extend between an inner wall (39) of the annular component (33). The struts (38) can hold the spring (32) in position. The struts (38) can compress the spring (32) such that the check valve (31) is favorably disposed to prevent fluid from flowing into the elbow (6) from the proximal end (3).

With respect to the elbow (6), a proximal portion (first portion, first open portion, first open end, open end) (40), as shown in FIG. 2, provides an outlet (41) formed by an inner surface (42). The proximal portion (40) can have a cylindrical body with an outlet (opening) (41). The proximal portion (40) can include a collar (annular body, projection, annular projection, raised collar) (19). The collar (19) can be raised with respect to the exterior surface (external surface, outer surface) (43), and/or the outer circumference thereof, of the elbow (6) and/or proximal portion (40). The collar (19) can extend radially away from the external surface (43). The exterior surface (44) of the collar (19) can be cylindrical in shape. The exterior surface (44) can have two peripheral channels (grooves, recesses, indentations) (45, 46) spaced apart from one another. The channels (45, 46) can receive O-rings (47, 48) respectively.

Figure 5:
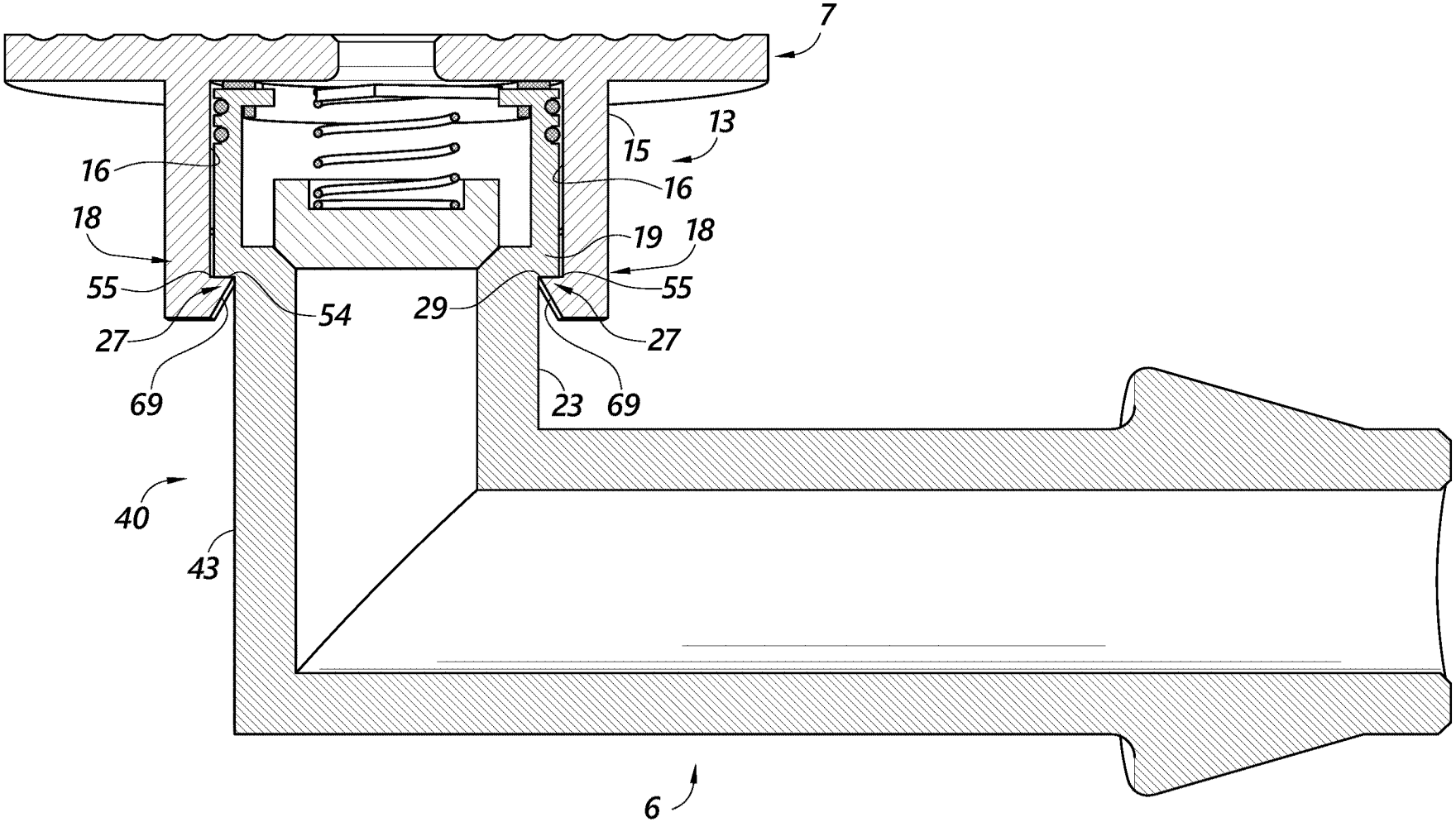
FIG. 5 shows the cross-sectioned air injector of FIG. 4 assembled.

O-rings (gaskets, elastic sealing materials) (47) and (48) seated in their respective channels (45) and (46) can provide an fluid and/or gas (e.g., air and/or water) tight seal with bath mount (4). As seen in FIG. 5, the O-rings (47, 48) can contact (press against) an inner surface (16) of the connector element (13) of the bath mount (4) to prevent the passage of fluid and/or gas (e.g., water and/or air) when the air injector (1) is in use.

Referring again to FIG. 2, the proximal portion (40) of the elbow (6) has one or more locking members (tabs, protrusions, flanges) (49). The one or more locking members (49) can include two, three, four, or more locking members (49). The locking members (49) can extend radially inward from the inner surface (42) of the outlet (41) of the elbow (6). Relatedly, the wall (36) of cap member (33) can include a number (corresponding to the number of locking members (49)) of channels (cutouts, openings, apertures) (50) to receive the locking members (49). The channels (50) can be L-shaped, C-shaped, or other shapes. Each channel (50) can include an axially extending opening (51) and a circumferentially extending channel (52) that are connected. Each opening (51) is sized to receive a respective locking member (49). Upon rotation of the cap member (33), the locking member (49) can travel into the respective channel (52). Positioning each locking member (49) in a circumferential channel (52) prevents axial separation of cap member (33) from the proximal portion (40) of elbow (6). In this position, the cap member (33) can compress the spring (32) against check valve (31) such that the check valve (31) is positioned into an internal seating (53) inside proximal portion (40) of the elbow (6), as can be seen in FIGS. 4 and 5. The internal seating (53) can be a circumferential annular surface that contacts the check valve (31) to create an fluid and/or gas (e.g., air and/or water) tight seal. The check valve (31) can be releasably retained inside proximal portion (40). In the absence of pressurized fluid and/or gas (e.g., air), the check valve (31) can interface with the internal seating (53) to prevent the flow of fluid, such as water, into the elbow (6). In the presence of sufficiently pressurized fluid and/or gas (e.g., air) flowing into the inlet (20) at a predetermined/desired pressure, the check valve (31) can overcome the force of the spring (32) to separate the check valve (31) from the internal seating (53) such that pressurized fluid and/or gas (e.g., air) flows through the internal chamber (17) and into the bathing environment via the hole (11). The pressurized fluid and/or gas (e.g., air) can continue to prevent the flow of fluid into the elbow (6).

Connector elements (connectors, arms, clips, protrusions, grips, hooks) (18) of bath mount (4), will now be more particularly described by reference to FIG. 5. Connector elements (18) can, via a clipping action, releasably couple the bath mount (4) to elbow (6). The connector elements (18) can facilitate a snap-fit connection with the raised collar (19). The connector elements (18) can deflect outward upon placement over the raised collar (19) and return to an un-deflected state upon extending beyond a distal surface (annular retaining surface, distal end, surface) (54) of the collar (19), as shown in FIG. 5, to couple the bath mount (4) to the elbow (6). The connector elements (18) can be made of a material with at least some flexibility to allow for temporary deflection of the connector elements (18). The distal surface (54) of the collar (19) can extend perpendicularly relative to the exterior surface (43) of the proximal portion (40) of the elbow (6) to provide a surface to retain the connector elements (18). The connector elements (18) can be varying lengths to accommodate collars (19) of different lengths. The distal surface (54) can form an annular retention surface such that the elbow (6) can be rotated with respect to the bath mount (4) to varying orientations while the connector elements (18) remain engaged with the distal surface (54). This can advantageously allow the elbow (6) to be conveniently coupled to the bath mount (4) at varying orientations, making installation less time consuming and/or costly.

Each of the connector elements (18) can have a retention feature (hook, clip, catch) (27) that interfaces with the distal surface (54) of the collar (19). The retention feature can be positioned at an end of the connector element (18). The retention feature (27) can include an interfacing surface (55) that can interface with the distal surface (54). The interfacing surface (55) can extend radially inward relative to the inner surface (16). The interfacing surface (55) can extend radially inward to varying lengths relative to the inner surface (16) to accommodate varying sizes of distal surfaces (54). The engagement between the distal surface (54) and the interfacing surface (55) can removably and securely couple the bath mount (4) to the elbow (6). The retention feature (27) can include an angled surface (69). The angled surface (69) can be angled relative to the inner surface (16). The angled surface (69) can extend to the innermost portion of the interfacing surface (55). The junction of the angled surface (69) and interfacing surface (55) can form an edge (29). Accordingly, the retention features (27) of the connection elements (18), as described above, engagement with the collar (19) can be described as a clip fitting and/or snap-fitting. Specifically, the clips (27) at ends of the arms (18) engage with the collar (19) to form a clip fitting connection between the bath mount (4) and the elbow (6).

Figure 6:
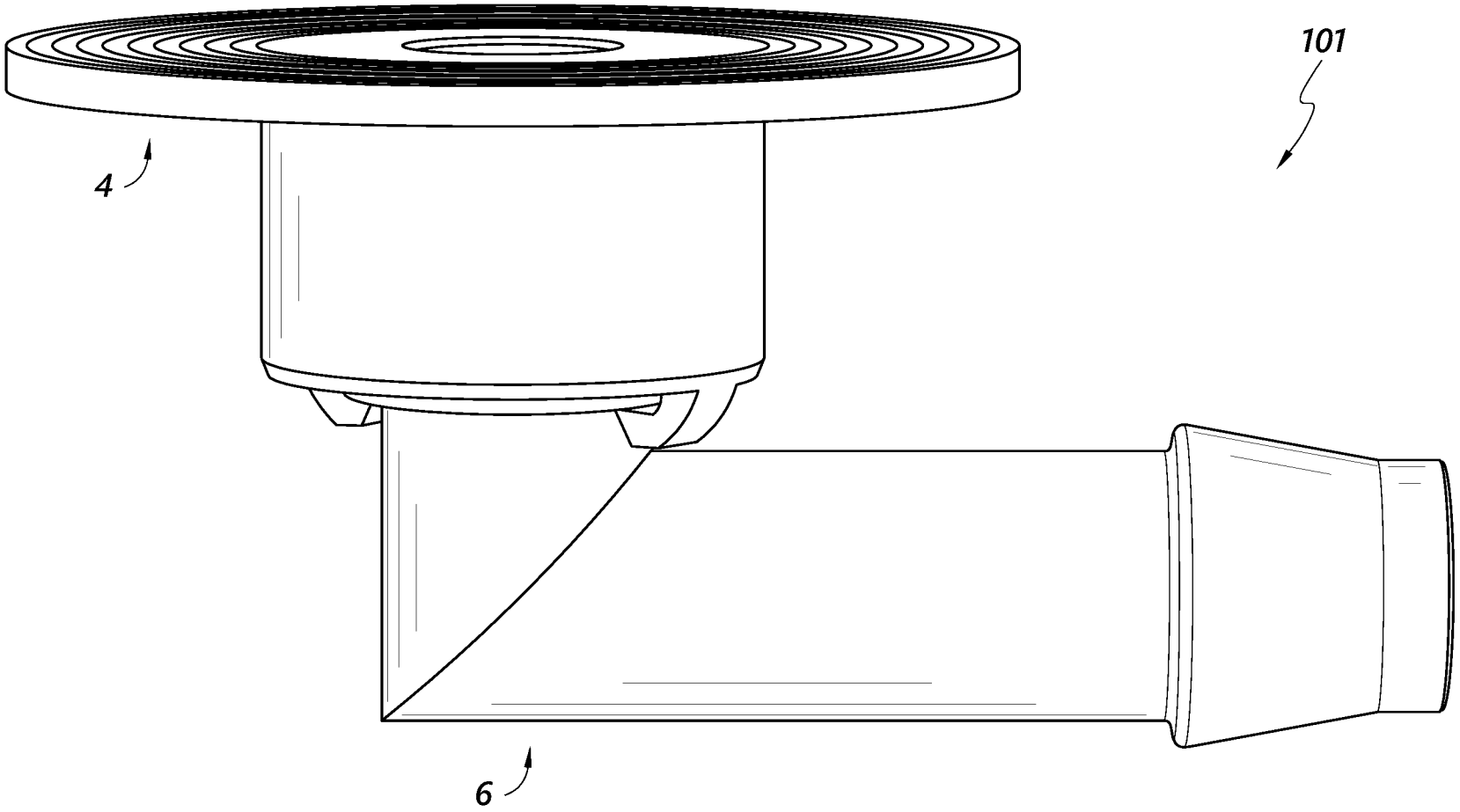
FIG. 6 is an illustration of an air injector of this disclosure in side elevation view.

FIG. 6 illustrates an air injector (101) similar to the air injector (1) of the previous Figures. Air injector (101) comprises a bath mount (4) connected to a pipe fitting (e.g., elbow) (6).

Figure 7:
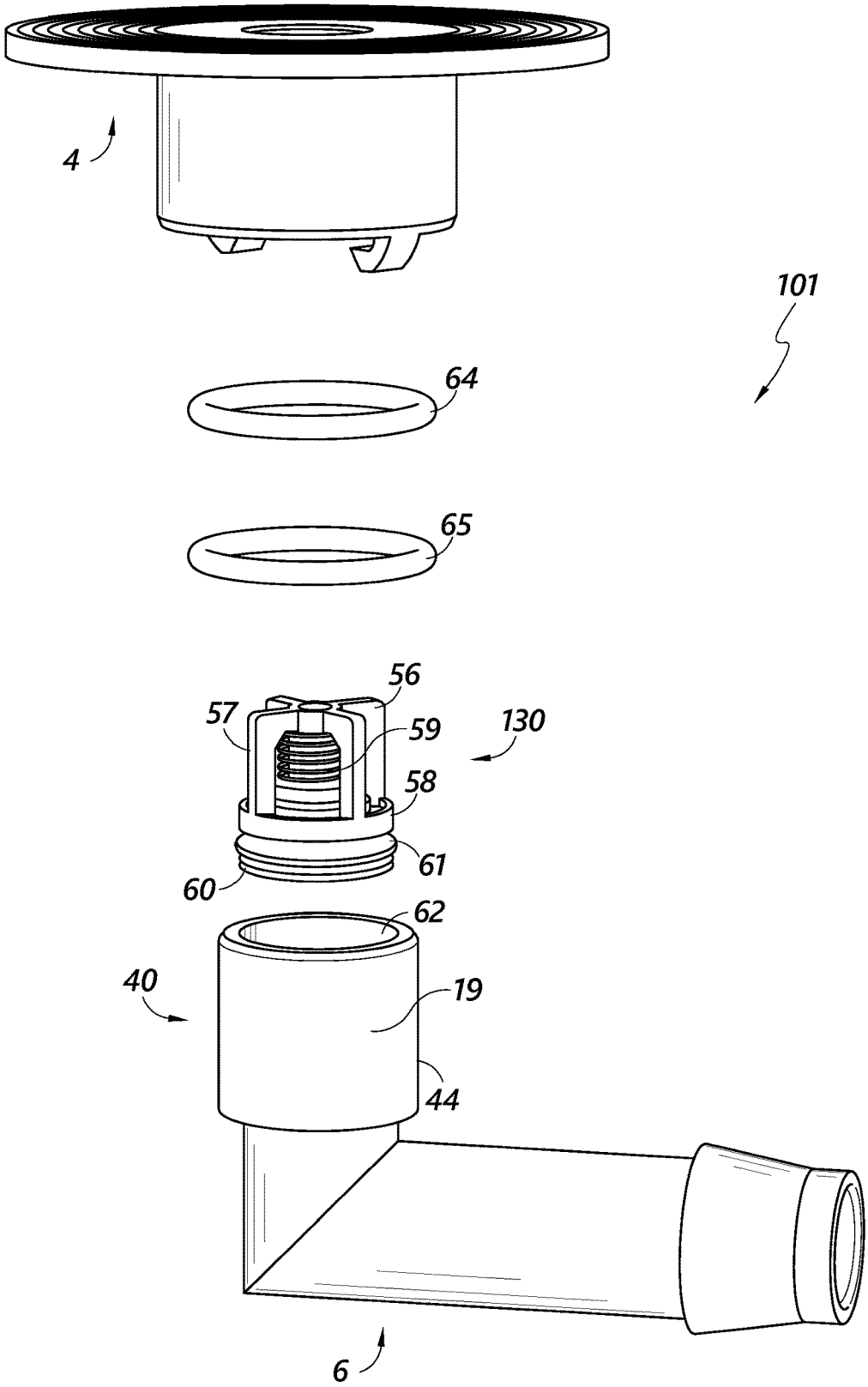
FIG. 7 is a perspective view of the air injector of FIG. 6 exploded to illustrate certain internal elements.

As shown in FIG. 7, valve assembly (valve, flow controller) (130), similar to valve assembly 30, inhibits the flow of water into pipe fitting (6) while allowing the one-way flow of pressurized fluid and/or gas (e.g., air) through the air injector (101). The valve assembly (130) can include a frame (56) forming a cage around the check valve (59). The frame (56) can include a plurality of struts (braces, uprights, supports) (57) extending from an annular base (58). The frame (56) can surround a check valve (59). The check valve (59) can be spring operated to prevent and allow flow. The frame (56) can engage with a housing (60), such that the check valve (59) is positioned between the frame (56) and the housing (60). The housing (60) can include a groove to receive an O-ring (61) that can inhibit the flow of fluid around the check valve assembly 130 and into the pipe fitting (6).

Specifically, housing (60) and O-ring (61) are sized to fit within the proximal portion (40) of the pipe fitting (6) such that the O-ring (61) engages with the inner surface (62) of the proximal portion (40) to prevent flow and such that the housing (60) rests on the surface (seat, support, internal seating) (67), shown in FIG. 4. In some embodiments, a hole (aperture, opening) (131) in the housing (60), shown in FIG. 8, can be plugged and unplugged by the check valve (59) to allow and inhibit flow therethrough. In some embodiments, the top of the frame (56) can engage with the lower surface (9) of the plate member (7) to prevent axial movement in the direction of the plate member (7).

Figure 8:
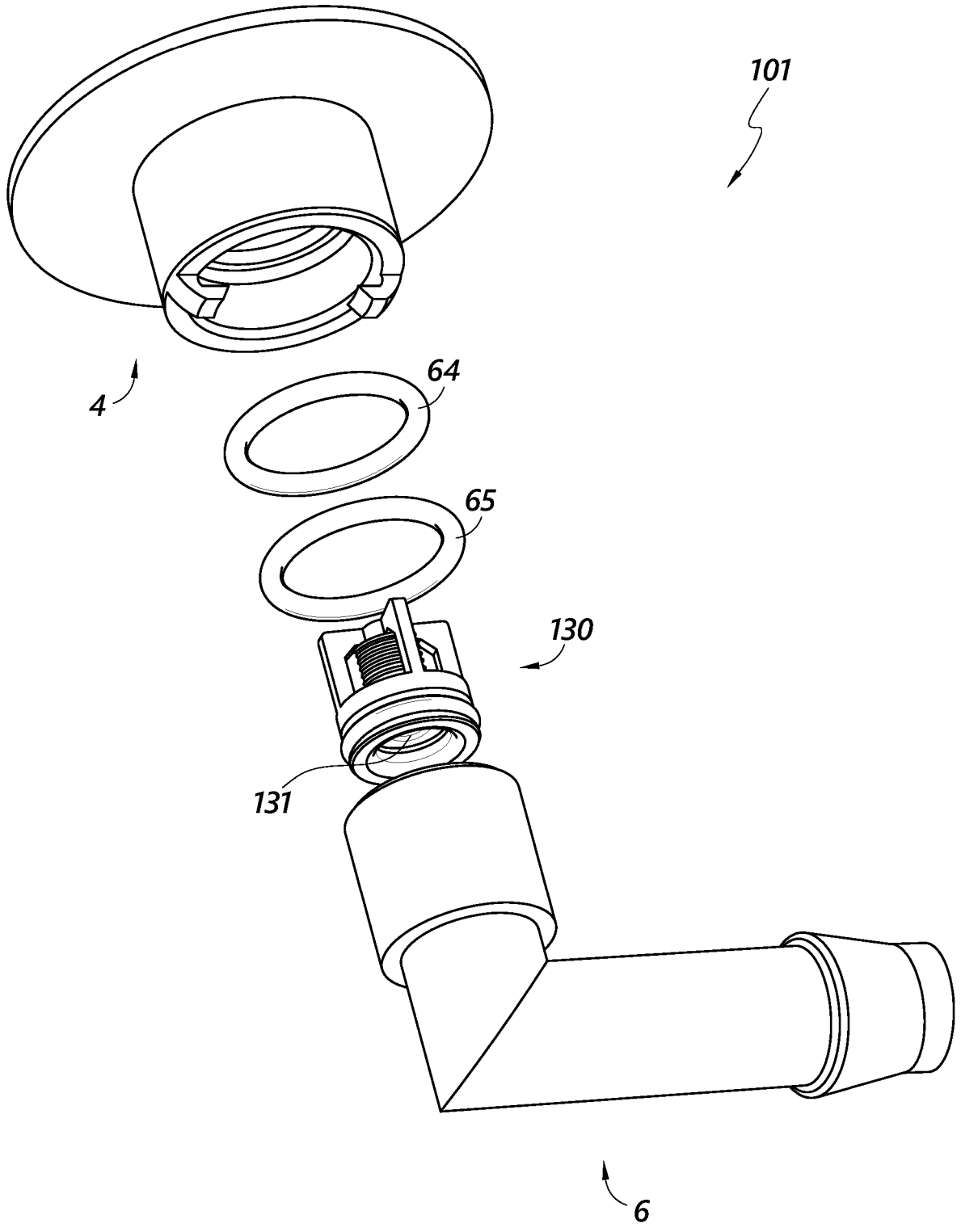
FIG. 8 is a generally bottom perspective view of the air injector of FIG. 7.
Figure 9:
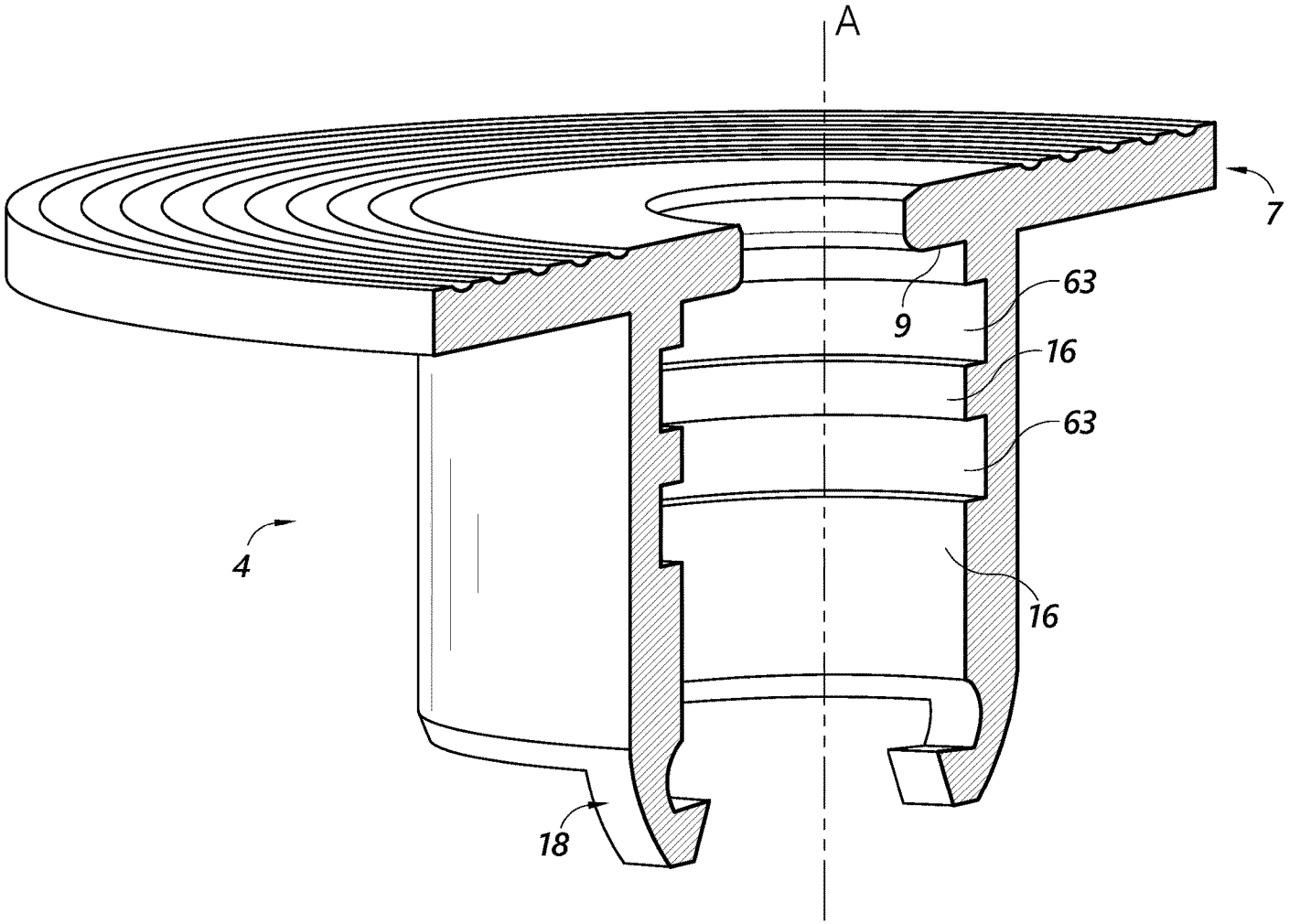
FIG. 9 is a perspective section view of a bath mount of the air injector of FIG. 6.

As seen in FIG. 9, the inner surfaces (16) of bath mount (4) can include annular grooves (channels, recesses) (63) that can receive O-rings (64, 65), shown in FIGS. 7 and 8. When the air injector (101) is assembled, the O-rings (64, 65) can engage with the exterior surface (44) of the collar (19), shown in FIG. 7, to prevent the flow of fluid between the exterior surface (44) and the interior surfaces (16). In some embodiments, the exterior surface (44) of the collar (19) can include grooves, similar to grooves (63), that can receive the O-rings (64, 65), while the interior surface (16) of the bath mount (4) can be free from grooves. Placing the grooves on the exterior surface (44) of the collar (19) can make manufacturing via injection molding more convenient because less or no post-molding machining is needed.

The arms (18) can extend away from the bath mount (4). The arms (118) can be curved. The arms (118) can curve inward toward a central axis A. In some embodiments, this can facilitate an improved snap-fit connection by firmly returning the arms (18) to an un-deflected state after extending beyond the distal end of the collar (19).

Figure 10:
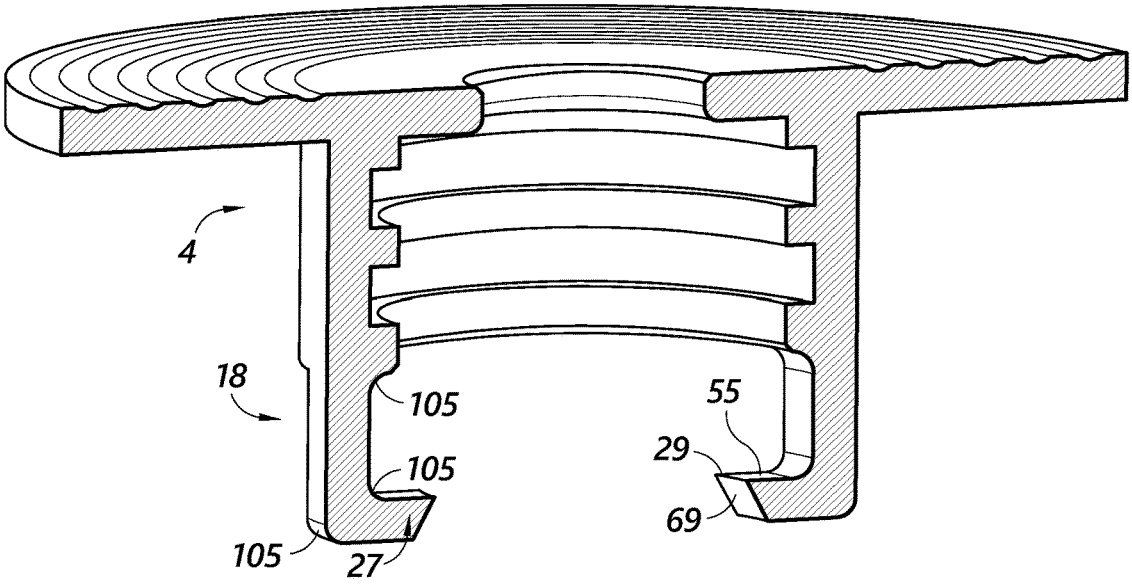
FIG. 10 is a perspective section view of a bath mount of an air injector.

FIG. 10 shows, according to some embodiments, the bath mount (4). The bath mount (4) can include one or more arms (18). The one or more arms (18) can extend away from the bath mount (4). The arms (18) can be elongate to provide improved flexibility for temporary deflection, extend the length of an elongate collar (19), and/or reduce the material required to form the connector housing (coupler housing) (13). The arms (118) can include a plurality of curves (105) to reduce stress concentrators, such as sharp angles, which can reduce the likelihood that the arms (18) will break during use. The curves (105) can also improve the deflection of the arms (18).

Figure 11:
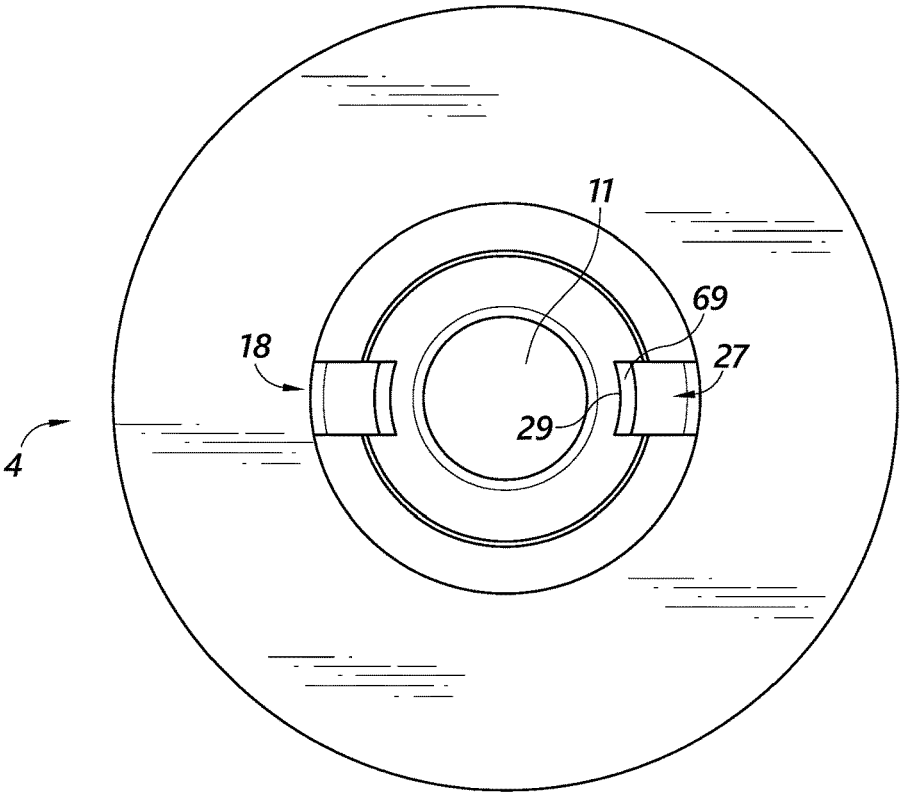
FIG. 11 is a bottom view of the bath mount of FIG. 10.

As shown in FIG. 11, the angled surface (69) and/or edge (29) of the retention feature (27) can be curved, which can enable the angled surface (69) and/or edge (29) to easily slide over the collar (19) as the bath mount (4) and the elbow (6) are being coupled together and/or easily rotate around the exterior surface (43) of the elbow (6) after coupling. In some embodiments, the curve of the angled surface (69) and/or edge (29) is curved such that the radius of curvature is the same as the collar (19)

Figure 12:
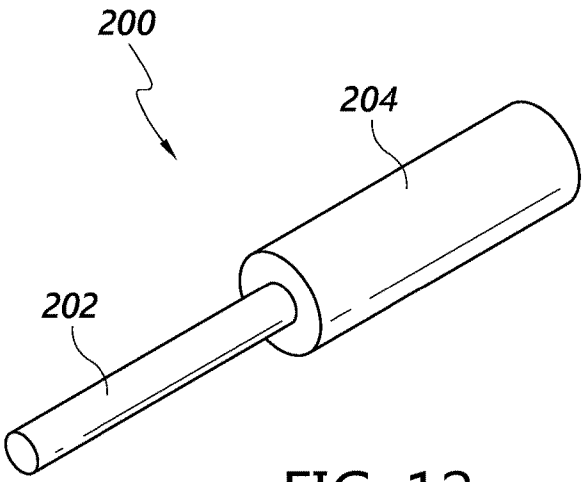
FIG. 12 is a perspective view of a tool that can be used to align a hole of the mounting cap with a hole in a wall of a bathing environment.

FIG. 12 illustrates a tool (200) that can be used to align the hole (11) of the bath mount (4) with a hole in the wall of a bathing environment. A user can grasp the tool (200) by the handle (204) and place a rod (202) of the tool (200) through the hole in the wall of the bathing apparatus. The flange member (7), with adhesive on the upper surface (8) can be advanced to interface the upper surface (8) with the outside surface of the bathing apparatus such that the flange member (7) is adhered to the outside surface of the bathing apparatus with the hole (11) aligned with the hole in the wall of the bathing apparatus. In some embodiments, a user can grasp the tool (200) by the handle (204) and place a rod (202) of the tool (200) through the hole (11) of the flange member (7), such that the handle (204) is positioned on the same side of the flange member (7) as the lower surface (9). The rod (2) and the flange member (7), with adhesive on the upper surface (8), can be maneuvered to position the rod (2) through a hole in the wall of the bathing apparatus. The flange member (7) can be advanced to interface the upper surface (8) with the outside surface of the bathing apparatus such that the flange member (7) is adhered to the outside surface of the bathing apparatus with the hole (11) aligned with the hole in the wall of the bathing apparatus. Further description regarding placement of the flange member (7) can be found in reference to FIG. 18 herein.

Figure 13:
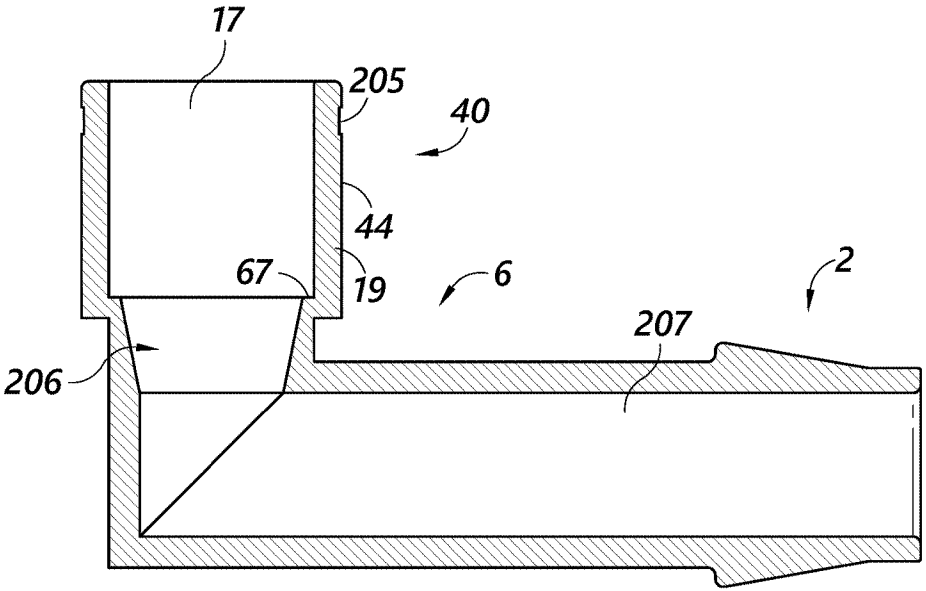
FIG. 13 is a side section view of an elbow pipe fitting of an air injector.

FIG. 13 illustrates, according to some embodiments, the elbow (6). The elbow (6) can include one or more grooves (205) on the exterior surface (44) of the collar (19). The one or more grooves (205) can receive O-rings to facilitate a sealed coupling between the elbow (6) and the bath mount (4). As described elsewhere herein, this can enable the elbow (6) to be injection molded with the grooves (205) while reducing or eliminating post-molding machining of the bath mount (4). The elbow (6) can also include a nozzle (206) that leads from the inner passageway (207) of the elbow (6) to the inner cavity (17) of the proximal portion (40). The nozzle (206) can have an increasing cross-sectional flow area in the distal-to-proximal direction.

Figure 14:
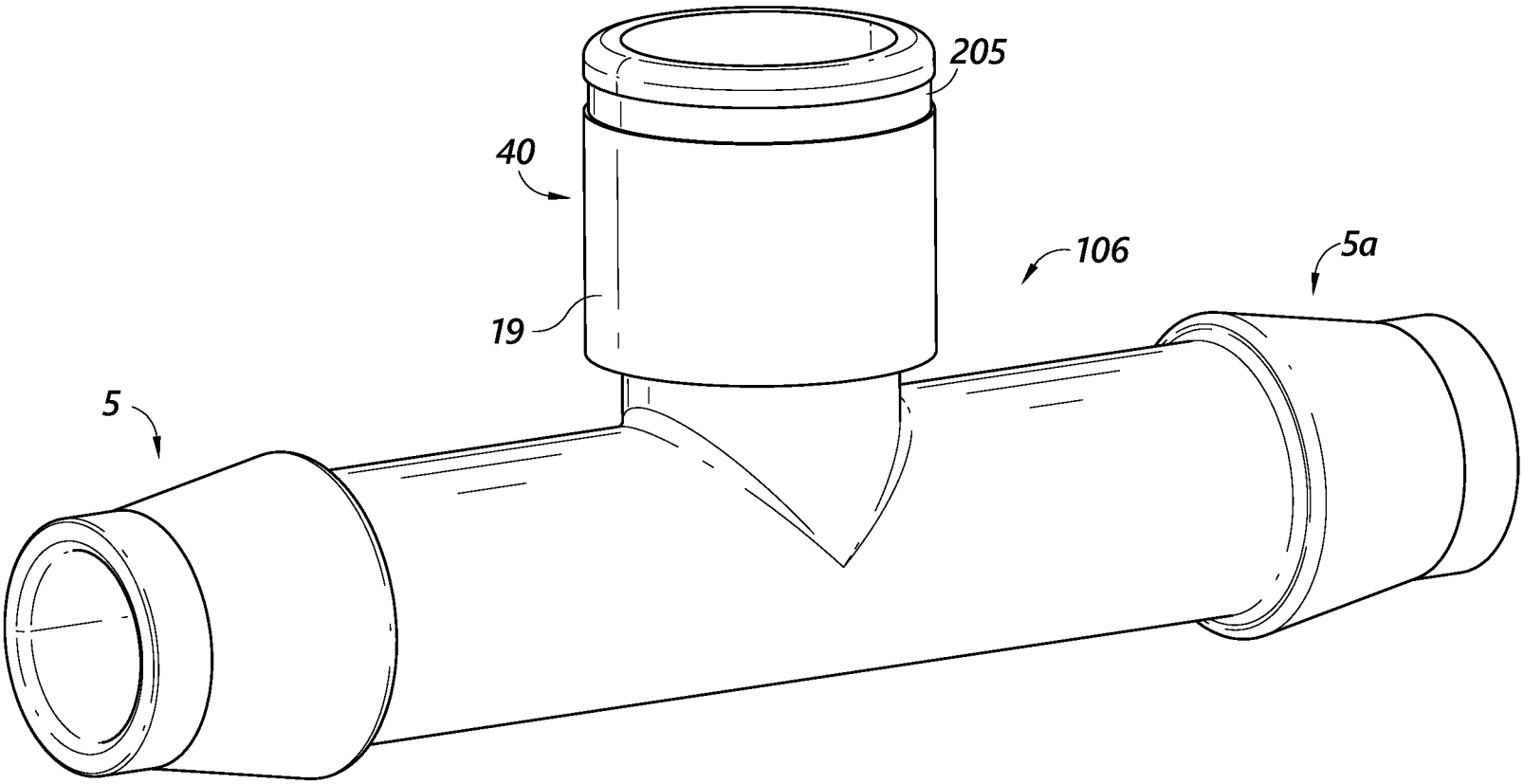
FIG. 14 is a perspective view of a T-fitting of an air injector.

FIG. 14 illustrates, according to some embodiments, a pipe fitting (106) that can be the same as the other pipe fittings described herein, apart from the illustrated and described differences. The pipe fitting (106) can be a T-fitting, that enables multiple air injectors to be connected in series. The pipe fitting (106) can include a first connector (nozzle, barbed nozzle, inlet) (5) at one end and a second connector (nozzle, barbed nozzle, inlet) (5*a*) at another end. The first connector (5) and the second connector (5*a*) can be the same. The pipe fitting (106) can include a proximal portion (40), between the first connector (5) and the second connector (5*a*), that couples to the bath mount (4). In use, a tube connected to a supply of pressurized fluid and/or gas (e.g., air) can be coupled to the first connector (5) of the first pipe fitting (106) and the second connector (5*a*) can be connected via another tube to the first connector (5) of a second pipe fitting (106). Multiple pipe fittings (106) can be coupled in series (two, three, four, or more) and terminated with an elbow (6). For example, in some embodiments, three pipe fitting 106 can be coupled in series and terminated with an elbow (6) to provide pressurized fluid and/or gas (e.g., air) into a bathing apparatus at four access holes.

Figure 15:
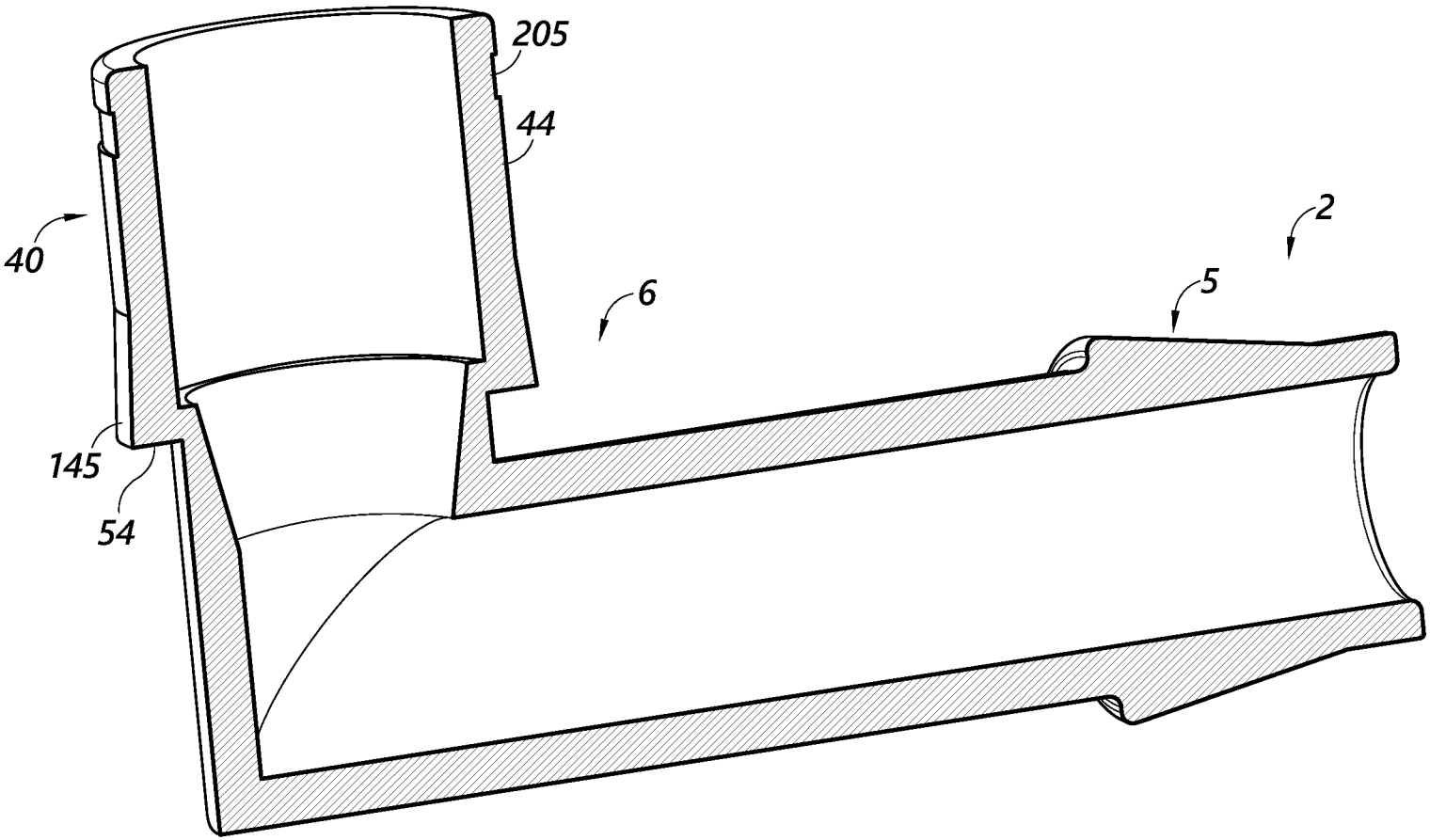
FIG. 15 is a perspective section view of an elbow pipe fitting of an air injector.

FIG. 15 illustrates, according to some embodiments, the elbow (6). The elbow (6) can include a proximal portion (40) with an exterior surface (44). The exterior surface (44) can include a flared portion (145). The flared portion (145) can be positioned on the distal portion of the proximal portion (40). The flared portion (145) can have an increasing profile (increasing periphery). The flared portion (145) can have an increasing profile in the distal-to-proximal direction. The flared portion (145) can cause the arms (18) of the bath mount (4) to deflect more radially outward compared to the exterior surface (44) as the bath mount (4) is coupled to the elbow (6), which can facilitate a secure snap-fit connection. For example, the flared portion (145) can define an enlarged distal surface (54), which can in turn provide more surface area to securely engage with the interfacing surface (55) of the one or more arms (18).

Figure 16:
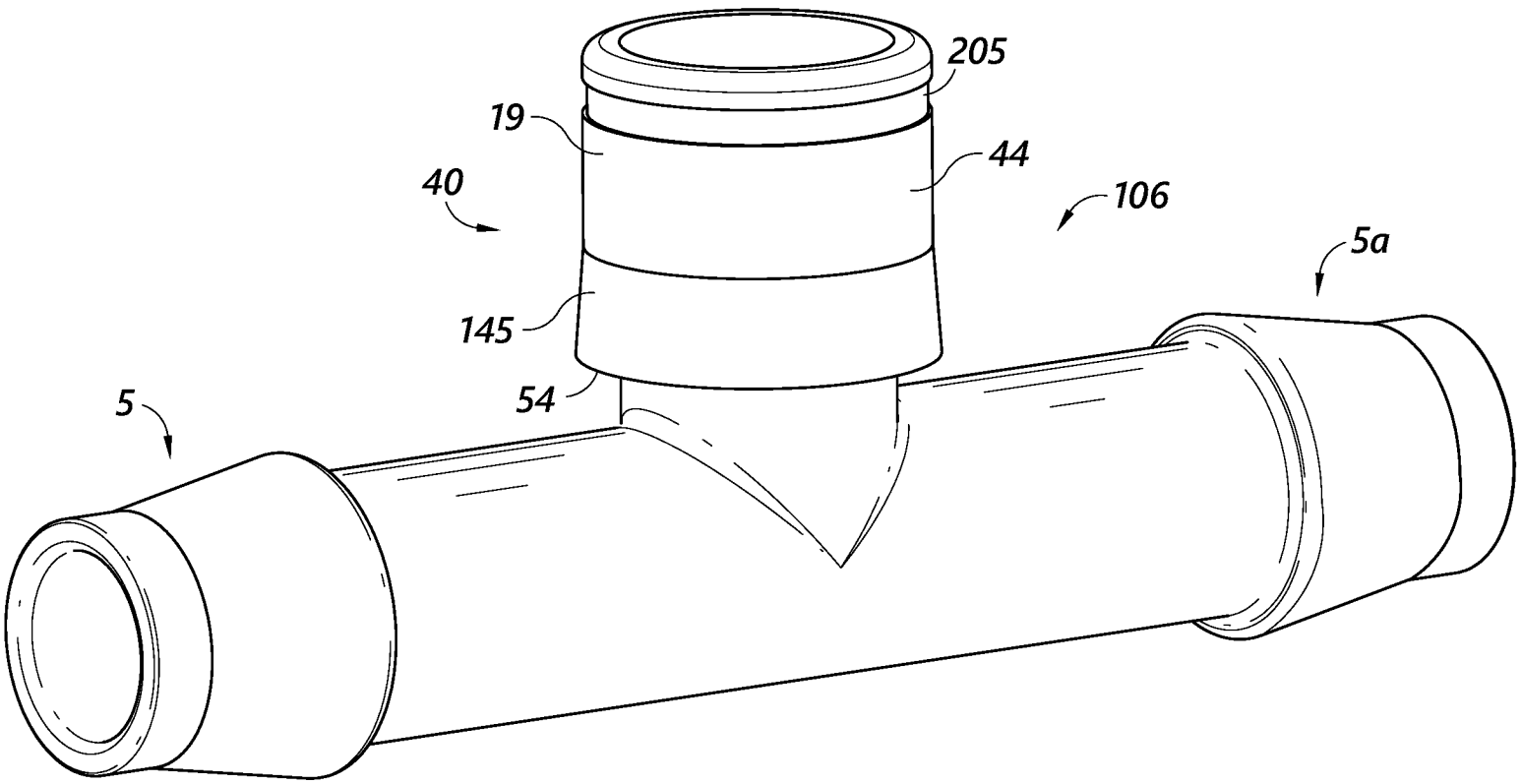
FIG. 16 is a perspective view of a T-fitting of an air injector.

FIG. 16 illustrates, according to some embodiments, the pipe fitting 106. The pipe fitting (106) can include a proximal portion (40) with a collar (19) and an exterior surface (44). The exterior surface (44) can include a flared portion (145) that is the same as the flared portion (145) described in reference to FIG. 15.

Figure 17:
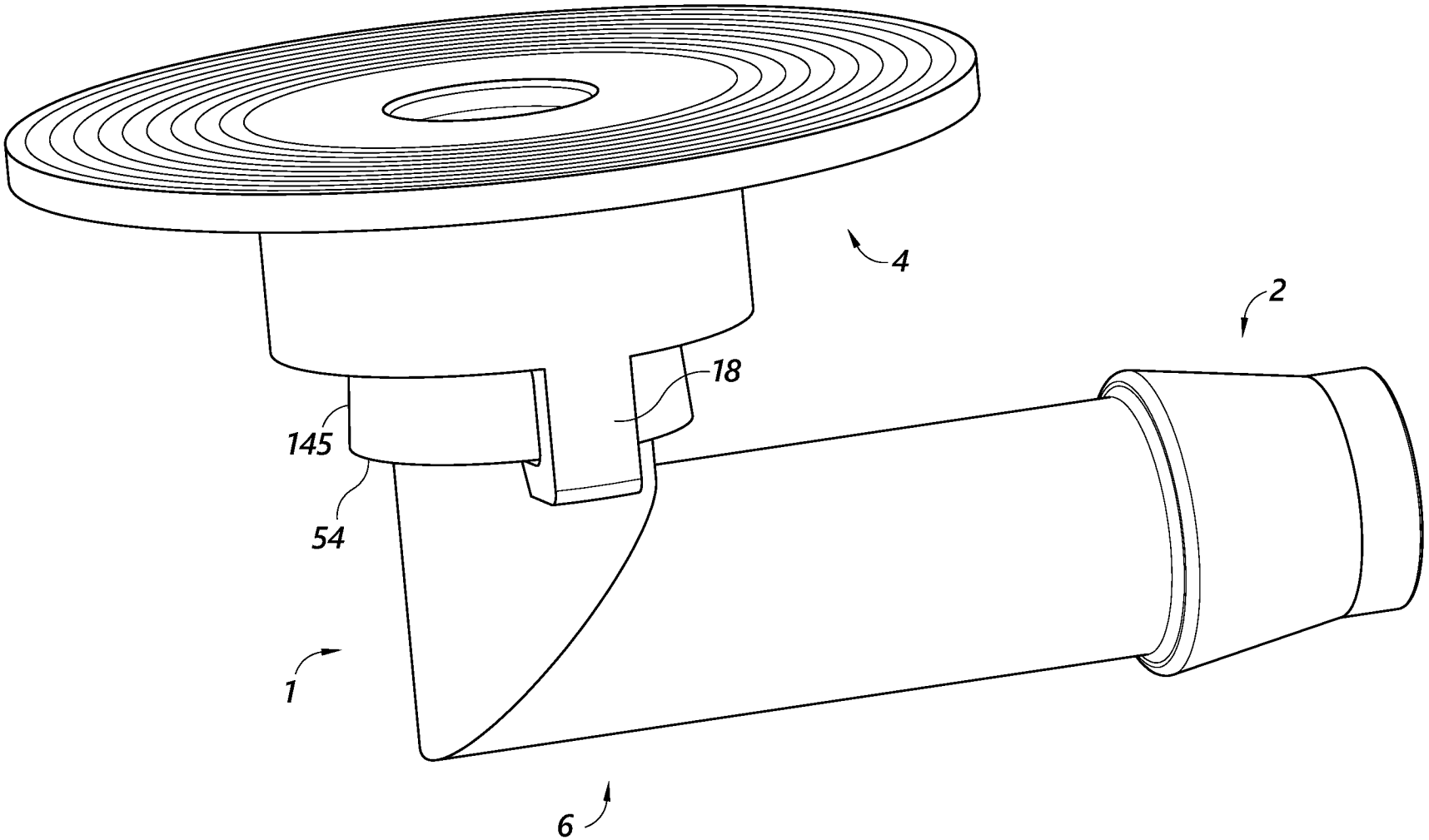
FIG. 17 is a perspective view of an assembled air injector.

FIG. 17 illustrates air injector (1) with the bath mount (4) coupled to the elbow (6). As shown, the arms (18) extend past the flared portion (145) to engage with the enlarged distal surface (54) such that the bath mount (4) is securely coupled to the elbow (6).

Figure 18:
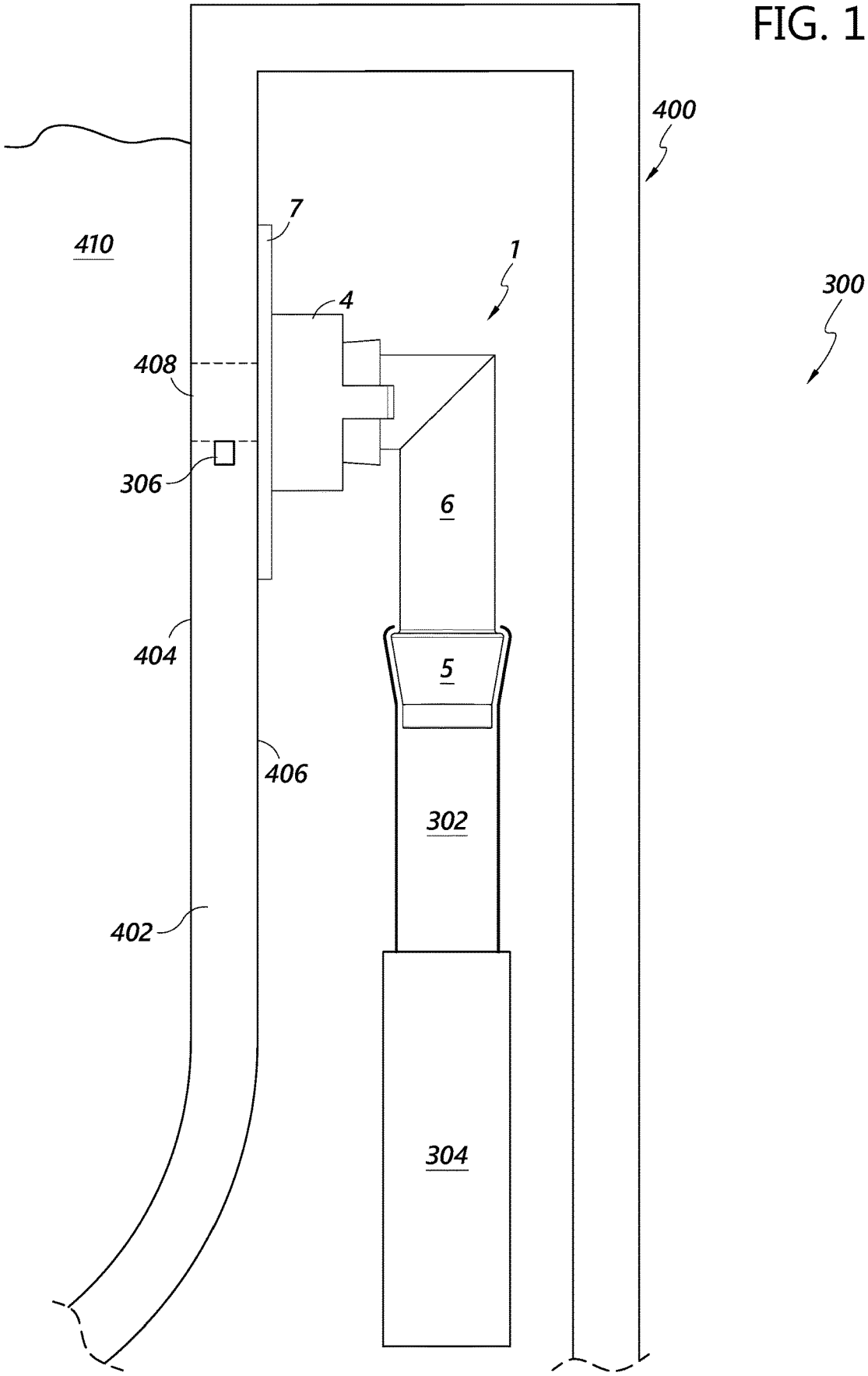
FIG. 18 is a side view of an air injector system installed to a bathing apparatus.

FIG. 18 illustrates an air injector system (300) installed in a bathing apparatus (tub, walk-in tub, free-standing tub) (400). The air injector system (300) can include an air injector (1), tube (pipe, conduit) (302), and a pump (304). The connector (5) of the air injector (1) can be connected to a tube (302) that is operatively connected to a pump (304). The pump (304) can provide (e.g., selectively provide) fluid and/or gas (e.g., air) to the air injector (1) via the tube (302). In some embodiments, the pump (304) can provide pressurized fluid and/or gas (e.g., air) to the air injector (1). In some embodiments, the pump (304) can provide another fluid or gas to the air injector (1). In some embodiments, the pump (304) can be operated by a user to selectively provide fluid and/or gas (e.g., air) to the air injector (1) to provide bubbles (pressurized bubbles, stream of bubbles) into the bathing environment.

The air injector (1) can be coupled to the wall (402) of the bathing apparatus (400). The wall (402) has a surface (404) that interfaces with fluid (410) that is contained by the bathing apparatus (400). The surface (404) can be referred to as the wet surface, inner surface, visible surface, and/or inside surface. The wall (402) has a surface (406) that is on an opposing side of the wall (402) relative to the surface (404). The surface (406) can be referred to as the dry surface, outer surface, hidden surface, non-visible surface, and/or outside surface. As shown, the plate (7) of the bath mount (4) can be adhered or attached with any suitable method including fasteners, snap fit, friction fit, and/or the like to the surface (406). This can advantageously hide, or mostly or substantially hide (e.g., substantially not visible), the air injector (1) from the view of a user in the bathing apparatus (400). In some embodiments, the air injector (1) and/or related components (e.g., tube (302) and/or pump (304) can be positioned within a cavity (412) of the bathing apparatus (400). In some embodiments, the cavity (412) be formed by the wall (402) and/or other walls of the bathing apparatus (400). The plate (7), as described elsewhere herein, can be positioned such that a hole (408) through the wall (402) is aligned (coaxial) with the hole (11) in the plate (7) such that fluid and/or gas (e.g., air) flowing through the air injector (1) can flow through the hole (408) and into the fluid (410) in the bathing apparatus (400). In some embodiments, the user of the bathing apparatus (400) can see the hole (408) but cannot, or mostly cannot, see the air injector (1).

In some embodiments, the air injector system (300) includes a sensor (306), or is operatively connected to a sensor (306), that senses the position of the fluid (410) and controls pump (304) based on the position of the fluid (410). For example, in some embodiments, the sensor (306) prevents the pump (304) from operating unless the fluid (410) covers the hole (408). In some embodiments, the sensor (306) prevents the pump (304) from operating unless the fluid (410) rises above the hole (408) by a predetermined amount.

The air injectors, bath mounts, and/or pipe fittings described herein can be made of a variety of materials, such as metals and/or polymers. The air injectors, bath mounts, and/or pipe fittings can be made with a variety of methods of manufacture, such as injection molding and machining.

What is claimed is:

1. An air injector for a bathing apparatus, comprising:

a mounting cap for attachment to an outside surface of the bathing apparatus, the mounting cap comprising:

a plate having an upper surface and a lower surface with a peripheral surface extending therebetween;

a hole extending through the upper and lower surface; and a housing having a receiving tube, wherein the receiving tube comprises a wall surrounding the hole and extending from a first end at said lower surface of the plate to a second, open end having an internal diameter and one or more engagement arms extending away from said second end; and a pipe fitting comprising:

a cylindrical body with an external surface having an outer circumference;

a first open end having a raised portion or portions extending at least partially around said outer circumference and radially away from the external surface, wherein the internal diameter of the receiving tube is sized to fit over the first open end of the pipe fitting with the engagement arms being configured to engage the raised portion or portions so as to releasably hold the mounting cap and pipe fitting together.

2. The air injector of claim 1, wherein the engagement arms includes two engagement arms that are positioned on opposing sides of the receiving tube.

3. The air injector of claim 2, wherein each of the engagement arms comprises a clip that is configured to engage with the raised portion or portions of the pipe fitting.

4. The air injector of claim 3, wherein the clip comprises a curved surface that has a radius of curvature that is the same as the raised portion or portions of the pipe fitting.

5. The air injector of claim 3, wherein the engagement arms are curved.

6. The air injector of claim 3, wherein the engagement arms are configured to engage with the raised portion or portions of the pipe fitting with a snap-fit connection.

7. The air injector of claim 3, wherein the engagement arms are configured to deflect radially outward over the raised portion or portions, and wherein the engagement arms are configured to return to an un-deflected state with the clip extending past the raised portion or portions.

8. The air injector of claim 1, wherein the pipe fitting rotates with respect to the mounting cap in a coupled configuration.

9. The air injector of claim 1, wherein the raised portion or portions comprise a flared portion that is configured to deflect the engagement arms radially outward.

10. The air injector of claim 1, wherein the raised portion or portions comprise one or more channels configured to receive O-rings that are configured to engage with an inner surface of the receiving tube.

11. The air injector of claim 1, wherein an inner surface of the receiving tube comprises one or more channels configured to receive O-rings that are configured to engage with the raised portion or portions.

12. The air injector of claim 1, comprising a check valve that is configured to provide for one-way flow through the air injector, wherein the check valve comprises a spring that applies a force that is configured to position the check valve to prevent fluid from flowing into the pipe fitting and that is configured to be overcome by pressurized air flowing through the pipe fitting to move the check valve to allow pressurized air to flow out the hole of the mounting cap.

13. The air injector of claim 1, wherein the pipe fitting comprises a barbed nozzle that is configured to operatively couple with a tube that supplies pressurized air.

14. The air injector of claim 13, wherein the pipe fitting comprises a second barbed nozzle that is configured to operatively couple with a tube that is connected to another air injector.

15. The air injector of claim 1, wherein the upper surface of the plate comprises grooves that are configured to receive an adhesive to couple the upper surface of the plate to an outer surface of a bathing apparatus.

16. An air injector for a bathing apparatus, comprising:

a bath mount comprising:

a plate having an upper surface and a lower surface, wherein the upper surface comprises one or more grooves configured to receive an adhesive to couple the upper surface of the plate to an outer surface of a wall of a bathing apparatus that is not configured to contact fluid held by the bathing apparatus;

a hole extending through the upper and lower surfaces of the plate, wherein the hole is configured to be aligned with a hole in the wall of the bathing apparatus;

a cylindrical body extending away from the lower surface of the plate that comprises an internal chamber; and one or more arms that extend away from the cylindrical body, wherein each of the one or more arms comprises a hook and is configured to deflect;

a pipe fitting comprising:

a second end comprising an inlet, wherein the second end is configured to operatively couple to tubing that is configured to direct pressurized air; and a collar positioned on a first portion of the pipe fitting, wherein the collar comprises an internal seating configured to receive a fluid check valve configured to prevent fluid flow through the pipe fitting away from the bathing apparatus, wherein the collar is configured to be inserted into the internal chamber of the cylindrical body such that the one or more arms extend beyond the collar, wherein a clip of each of the one or more arms is configured to couple to the collar with a snap-fit connection such that the pipe fitting and the bath mount are configured to be separable for servicing of the fluid check valve.

17. The air injector of claim 16, wherein the pipe fitting and the bath mount are configured to be separable for servicing of the fluid check valve without rotation of the pipe fitting with respect to the bath mount.

18. A method of installing an air injector in a bathing apparatus, the method comprising:

applying an adhesive to an upper surface of a plate;

aligning a hole of the plate with a hole in a wall of a bathing apparatus that is configured to hold a fluid;

adhering the upper surface of the plate to a hidden surface of a wall of the bathing apparatus that is opposite a surface that is configured to interface with the fluid held by the bathing apparatus;

inserting a check valve into a pipe fitting; and coupling a receiving tube attached to the plate with a collar of the pipe fitting with a snap-fit connection.

19. The method of claim 18, further comprising operatively coupling the pipe fitting to a tube that is configured to supply pressurized air.

20. The method of claim 18, wherein aligning the hole of the plate with a hole in a bathing apparatus comprises inserting a rod through the hole in the bathing apparatus and maneuvering the plate relative to the rod to position the rod through the hole of the plate.

21. The method of claim 18, wherein coupling the receiving tube attached to the plate with the collar of the pipe fitting with a snap-fit connection comprises:

inserting the collar of the pipe fitting into the receiving tube attached to the plate such that arms extending away from the receiving tube deflect radially outward; and advancing the collar of the pipe fitting into the receiving tube such that clips at the end of each of the arms snaps around an end of the collar to couple the pipe fitting to the plate.

* * * * *